US010760281B2

(12) United States Patent
MacDonald et al.

(10) Patent No.: US 10,760,281 B2
(45) Date of Patent: Sep. 1, 2020

(54) VENEER CONNECTORS, WALL BLOCKS, VENEER PANELS FOR WALL BLOCKS, AND WALLS

(71) Applicants: Robert A. MacDonald, Plymouth, MN (US); Robert John Lundell, Stillwater, MN (US)

(72) Inventors: Robert A. MacDonald, Plymouth, MN (US); Robert John Lundell, Stillwater, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 16/167,961

(22) Filed: Oct. 23, 2018

(65) Prior Publication Data

US 2019/0055736 A1 Feb. 21, 2019

Related U.S. Application Data

(63) Continuation of application No. 15/653,796, filed on Jul. 19, 2017, now Pat. No. 10,156,077.
(Continued)

(51) Int. Cl.
*E04F 13/08* (2006.01)
*E02D 29/02* (2006.01)
(Continued)

(52) U.S. Cl.
CPC ..... *E04F 13/0801* (2013.01); *E02D 29/025* (2013.01); *E04F 13/147* (2013.01); *E04F 13/24* (2013.01)

(58) Field of Classification Search
CPC ..... E04F 13/0801; E04F 13/147; E04F 13/24; E04B 2/14; E04B 2002/0256;
(Continued)

(56) References Cited

U.S. PATENT DOCUMENTS 894,122 A 7/1908 Dougherty
1,115,542 A 11/1914 Hudson
(Continued)

FOREIGN PATENT DOCUMENTS

CA 85895 2/1999
CA 2 526 876 A1 2/2006
(Continued)

OTHER PUBLICATIONS

Oct. 5, 2005 Notification of Transmittal of the International Search Report and the Written Opinion of the International Searching Authority, or the Declaration in PCT/US2005/014769 (12 pages).
(Continued)

*Primary Examiner* — Brian E Glessner
*Assistant Examiner* — Adam G Barlow
(74) *Attorney, Agent, or Firm* — Popovich, Wiles & O'Connell, P.A.

(57) ABSTRACT

Wall blocks, veneers, veneer connectors, walls, and methods of constructing walls are provided. More particularly, the invention relates to constructing walls in which a veneer panel is attached to a wall block with a connector and in which the front faces of the veneers have a desirable texture.

20 Claims, 19 Drawing Sheets

Related U.S. Application Data

(60) Provisional application No. 62/365,057, filed on Jul. 21, 2016.

(51) Int. Cl.
*E04F 13/14* (2006.01)
*E04F 13/24* (2006.01)

(58) Field of Classification Search
CPC ..... E02D 29/025; F16B 2/241; F16B 2/243; F16B 5/0052; F16B 5/06; F16B 5/128; Y10T 24/304; Y10T 24/306; Y10T 24/307; Y10T 24/344
USPC ..... 52/386, 562, 588.1, 592.1, 597, 598, 52/604–606
See application file for complete search history.

(56) References Cited

U.S. PATENT DOCUMENTS 1,366,470 A 1/1921 Lampert
1,462,374 A 7/1923 Vincent Metz Leo
1,593,297 A 7/1926 Gilmer
1,962,906 A 6/1934 Mueller
2,121,037 A 6/1938 Kotrbaty
2,130,531 A 9/1938 Arand
2,216,047 A * 9/1940 Place ..... F16B 5/125 52/718.06
2,316,819 A 4/1943 Tedrow
2,569,021 A 9/1951 Rozanski
2,707,052 A * 4/1955 Brown ..... A47K 1/09 211/65
2,918,814 A 12/1959 Farina
3,102,367 A 9/1963 Pedersen et al.
3,555,757 A 1/1971 Volent
3,660,954 A 5/1972 Logan
3,686,873 A 8/1972 Vidal
3,775,927 A * 12/1973 Meyer ..... F16B 5/128 52/718.06
3,815,370 A 6/1974 Lennox
3,895,469 A 7/1975 Kapitan
3,946,877 A 3/1976 Galicia
3,950,908 A 4/1976 Van Eyk
4,229,920 A 10/1980 Lount
4,238,105 A 12/1980 West
4,263,765 A 4/1981 Maloney
D269,851 S * 7/1983 Kimura ..... D8/356
4,449,857 A 5/1984 Davis
4,454,693 A 6/1984 Price
4,454,699 A 6/1984 Strobl
D274,601 S 7/1984 Helmle
4,470,728 A 9/1984 Broadbent
4,545,703 A 10/1985 Boynton
4,564,316 A 1/1986 Hunziker
4,593,513 A 6/1986 Stratton
4,661,023 A 4/1987 Hilfiker
4,684,287 A 8/1987 Wojciechowski
4,703,602 A * 11/1987 Pardo ..... E02D 29/0241 52/223.7
4,706,429 A 11/1987 Young
4,765,109 A 8/1988 Boeshart
4,884,382 A 12/1989 Horobin
4,884,921 A 12/1989 Smith
4,885,888 A 12/1989 Young
4,887,691 A 12/1989 Rotondo
4,894,969 A 1/1990 Horobin
4,913,594 A 4/1990 Sigourney
4,967,532 A 11/1990 Castle et al.
4,993,879 A 2/1991 Hilfiker
D317,112 S * 5/1991 Newuirth ..... D8/356
D333,256 S * 2/1993 Newcomer ..... D8/356
5,211,521 A * 5/1993 Page ..... F16B 5/0642 411/182
5,428,933 A 7/1995 Philippe
5,524,405 A 6/1996 Byrd
5,538,363 A 6/1996 Eastwood
5,551,810 A 9/1996 Franceski et al.
5,567,089 A 10/1996 Akamine
5,588,786 A 12/1996 House et al.
5,623,797 A 4/1997 Gravier et al.
D379,060 S * 5/1997 Laga ..... D8/373
5,688,078 A 11/1997 Hammer
5,735,643 A 4/1998 Castonguay et al.
5,788,423 A 8/1998 Perkins
5,823,717 A 10/1998 Bastick et al.
5,845,448 A 12/1998 Potvin
D404,146 S 1/1999 Perkins
5,878,545 A 3/1999 Gebhart
5,930,964 A 8/1999 Boehning
5,934,035 A 8/1999 Rasmussen et al.
6,024,516 A 2/2000 Taylor et al.
6,062,772 A 5/2000 Perkins
6,070,380 A 6/2000 Meilleur
6,141,933 A 11/2000 McClinton
6,148,576 A 11/2000 Janopaul, Jr.
6,176,049 B1 1/2001 Crant et al.
6,230,462 B1 * 5/2001 Beliveau ..... E04B 2/8617 52/426
6,247,280 B1 6/2001 Grinshpun et al.
6,314,697 B1 11/2001 Moore, Jr.
6,318,040 B1 * 11/2001 Moore, Jr. ..... E04B 2/8617 52/379
6,321,497 B1 11/2001 Cormier
D454,740 S * 3/2002 Baggott ..... D6/534
6,363,683 B1 4/2002 Moore, Jr.
6,374,556 B2 4/2002 Crant et al.
6,393,789 B1 5/2002 Lanclos
6,401,419 B1 6/2002 Beliveau
6,443,666 B1 9/2002 Smith
6,523,312 B2 2/2003 Budge
6,526,713 B2 * 3/2003 Moore, Jr. ..... B28B 19/003 52/309.11
6,536,172 B1 * 3/2003 Amend ..... E04B 2/8617 249/213
6,536,994 B2 3/2003 Race
6,578,338 B1 6/2003 Nanayakkara
D477,771 S 7/2003 Nemoto
6,607,683 B1 8/2003 Harrington
6,615,561 B2 9/2003 MacDonald et al.
6,668,502 B2 12/2003 Beliveau
6,668,503 B2 12/2003 Beliveau
6,708,459 B2 3/2004 Bodnar
6,758,636 B2 7/2004 Rainey et al.
6,792,729 B2 * 9/2004 Beliveau ..... E04B 2/8617 52/279
6,820,384 B1 11/2004 Pfeiffer
6,827,527 B2 12/2004 Conkel et al.
6,848,228 B1 2/2005 Williams
D508,739 S 8/2005 Shillingburg
D509,911 S 9/2005 Shillingburg
6,964,137 B2 11/2005 Frascari
6,978,581 B1 12/2005 Spakousky
6,990,774 B2 1/2006 Clapp
7,032,357 B2 4/2006 Cooper et al.
7,082,731 B2 8/2006 Patz et al.
7,082,732 B2 * 8/2006 Titishov ..... E04B 2/8617 52/426
7,121,051 B2 10/2006 Hunsaker
7,165,374 B2 1/2007 Chanesian
7,165,916 B2 1/2007 Nanayakkara
7,168,892 B1 1/2007 MacDonald et al.
7,235,204 B2 6/2007 Harrington
7,410,328 B2 8/2008 Hamel
7,415,805 B2 8/2008 Nickerson
D584,599 S 1/2009 Chavez
D597,402 S 8/2009 Garza
D610,436 S 2/2010 Bremmon
7,669,375 B2 3/2010 Everett
7,730,688 B2 6/2010 Pfeiffer
7,827,752 B2 11/2010 Scherrer
7,963,727 B1 6/2011 Wauhop
D651,592 S 1/2012 Hunter
8,234,828 B2 8/2012 MacDonald
D672,886 S 12/2012 MacDonald

(56) References Cited

U.S. PATENT DOCUMENTS

| | | | | |
|---|---|---|---|---|
| D677,097 | S * | 3/2013 | Page | D6/606 |
| 8,402,701 | B2 | 3/2013 | Arteon | |
| 8,511,024 | B2 | 8/2013 | MacDonald et al. | |
| 8,613,174 | B2 * | 12/2013 | Garrett | E04B 2/8635 52/309.11 |
| 8,656,678 | B2 * | 2/2014 | MacDonald | E02D 29/025 52/562 |
| 8,800,227 | B2 | 8/2014 | LeBlang | |
| 8,919,067 | B2 | 12/2014 | Crosby | |
| D746,661 | S * | 1/2016 | Shetti | D8/354 |
| D756,535 | S * | 5/2016 | Schlipf | D25/68 |
| D767,981 | S * | 10/2016 | Bilge | D8/382 |
| D773,693 | S | 12/2016 | Karau | |
| D774,381 | S | 12/2016 | Huang | |
| D774,876 | S | 12/2016 | Huang | |
| D776,515 | S | 1/2017 | Huang | |
| D777,561 | S | 1/2017 | Huang | |
| 9,574,317 | B2 * | 2/2017 | MacDonald | E02D 3/10 |
| D785,442 | S | 5/2017 | Tseng | |
| 9,810,253 | B2 * | 11/2017 | Koelling | F16B 12/24 |
| D812,781 | S | 3/2018 | MacDonald et al. | |
| D814,278 | S * | 4/2018 | MacDonald | D8/382 |
| D814,911 | S | 4/2018 | MacDonald et al. | |
| D815,938 | S | 4/2018 | MacDonald et al. | |
| 2001/0027630 | A1 | 10/2001 | Moore, Jr. et al. | |
| 2002/0078649 | A1 | 6/2002 | Clapp | |
| 2003/0074856 | A1 * | 4/2003 | Hammer | E04C 1/395 52/604 |
| 2004/0216408 | A1 | 11/2004 | Hohmann | |
| 2005/0204679 | A1 | 9/2005 | Pfeiffer | |
| 2005/0204699 | A1 | 9/2005 | Rue | |
| 2005/0242468 | A1 | 11/2005 | MacDonald et al. | |
| 2005/0252144 | A1 | 11/2005 | MacDonald et al. | |
| 2005/0252145 | A1 | 11/2005 | MacDonald et al. | |
| 2005/0252146 | A1 | 11/2005 | MacDonald et al. | |
| 2005/0252147 | A1 | 11/2005 | MacDonald et al. | |
| 2006/0197257 | A1 | 9/2006 | Burt et al. | |
| 2006/0260240 | A1 | 11/2006 | Patz et al. | |
| 2006/0263575 | A1 | 11/2006 | Ritchie | |
| 2007/0044426 | A1 | 3/2007 | Deans | |
| 2007/0151190 | A1 | 7/2007 | Huff et al. | |
| 2008/0057801 | A1 | 3/2008 | Duffy | |
| 2008/0289282 | A1 | 11/2008 | MacDonald | |
| 2008/0313988 | A1 * | 12/2008 | MacDonald | E02D 29/02 52/385 |
| 2009/0013638 | A1 | 1/2009 | Clarno | |
| 2009/0090077 | A1 | 4/2009 | Rodebaugh et al. | |
| 2009/0151281 | A1 | 6/2009 | MacDonald et al. | |
| 2011/0072753 | A1 * | 3/2011 | MacDonald | E04B 2/14 52/562 |
| 2011/0078978 | A1 | 4/2011 | Wauhop | |
| 2011/0243669 | A1 | 10/2011 | Friederichs | |
| 2011/0318100 | A1 | 12/2011 | Rainey | |
| 2012/0186170 | A1 | 7/2012 | MacDonald et al. | |
| 2014/0150368 | A1 | 6/2014 | MacDonald | |
| 2014/0260029 | A1 * | 9/2014 | Browning | E04B 2/14 52/309.4 |
| 2016/0069078 | A1 | 3/2016 | MacDonald | |
| 2016/0168865 | A1 | 6/2016 | Pervan | |

FOREIGN PATENT DOCUMENTS

| | | | |
|---|---|---|---|
| WO | WO 2004/076759 | A2 | 9/2004 |
| WO | WO 2005/108683 | A1 | 11/2005 |
| WO | WO 2007/069027 | A2 | 6/2007 |
| WO | WO 2008/092237 | A1 | 8/2008 |
| WO | WO 2011/109621 | A1 | 9/2011 |

OTHER PUBLICATIONS

Mar. 3, 2011 PCT International Search Report and Written Opinion in corresponding International Application No. PCT/US2010/050670 (13 pages).

Oct. 23, 2017 PCT Invitation to Pay Additional Fees in corresponding International Application No. PCT/US2017/042761 (12 pages).

Jan. 2, 2018 PCT Transmittal of the International Search Report and the Written Opinion in corresponding International Application No. PCT/US2017/042761 (16 pages).

Sep. 20, 2017 Examiner's Report from corresponding Canadian Industrial Design Application No. 172560 (1 page).

* cited by examiner

VENEER CONNECTORS, WALL BLOCKS, VENEER PANELS FOR WALL BLOCKS, AND WALLS

This application is a continuation of U.S. Ser. No. 15/653,796, filed Jul. 19, 2017, which claims the benefit of U.S. Provisional Application No. 62/365,057, filed Jul. 21, 2016, the contents of each of which are hereby incorporated by reference herein.

FIELD OF THE INVENTION

The present invention relates to wall blocks, veneer panels, veneer connectors, and walls made from such blocks. In particular, this invention relates to wall blocks and veneer connectors that attach veneer panels to wall blocks and a pinning system that connects courses of blocks with veneer panels to adjacent courses of blocks with veneer panels to form walls that are straight, curvilinear, retaining or freestanding or that have 90 degree corners. Additionally, columns, pilasters and parapets may be constructed with the blocks and veneer panels of the present invention and optionally vertical and horizontal reinforcement members may be utilized in building any structure with the present invention.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

A widely accepted method of construction of such walls is to dry stack concrete wall units, or blocks. These blocks are popular because they are mass produced and, consequently, relatively inexpensive. They are structurally sound and easy and relatively inexpensive to install. Because they are made of concrete, they are durable. They can be given a desired appearance such as a natural stone appearance. Many block systems also use pins that are adapted to fit in corresponding pin holes in adjacent blocks or may use other mechanical means to contribute to the stability of a wall.

Typically, retaining wall blocks are manufactured to have the desired appearance on the front face (i.e., the outer face of a wall) because only the front is typically visible after the wall is constructed. It is highly desirable to have the front face of the wall system have a natural stone appearance, and many approaches are used in the art to treat or process concrete to evoke the appearance of natural stone, including splitting the block, tumbling the block to weather the face and edges of the face, and using machine textures built into the manufacturing equipment to impart a natural stone look to the concrete. Colored concrete in various forms and methods also is employed to mimic the look of natural stone.

There have been prior efforts to add a veneer to regular masonry and segmental retaining walls with natural stone or concrete that is pre-cast molded to closely resemble natural stone. While such veneering produces aesthetically pleasing walls, it is a laborious and highly expensive process, as it requires skilled masonry work to tie in the stone or concrete veneer to the wall using traditional mortared masonry construction methods. Such veneering can double the cost of the finished wall. In addition, reinforced soil (also known as mechanically stabilized earth (MSE)) segmental retaining walls are not rigid structures and applying a rigid mortared veneer may cause cracking of the veneer pieces or mortar areas unless appropriate steps are taken to provide slip joints that allow for such movement. Additionally, it has been proposed to attach veneers made from various materials to wall blocks or wall surfaces using a connecting means that does not require mortar. Although such veneers are advantageous in many respects improvements are needed. For example, it would be desirable to provide a block for use with a veneer that has been specifically designed and configured to form a wall that can be interlocked for stability and that can be used with veneers and compatible connectors to provide a wall structure that is both aesthetically pleasing and structurally sound. Further, it would be desirable to improve the connectors with which those veneers are attached to the blocks or wall surface.

SUMMARY OF THE INVENTION

This invention relates generally to wall blocks, veneer panels, and veneer connectors, and a method of constructing walls, retaining walls, free-standing walls or fence systems from the wall blocks, veneer connectors, and veneer panels. More particularly, the invention relates to constructing such walls or fence systems wherein a veneer panel is attached to a wall block with a connector and further wherein the front faces of the veneer panels have a desirable texture and further wherein the veneer panels can be connected to the wall blocks before, during or after construction of the wall or fence system.

It is to be understood that both the foregoing general description and the following detailed description are exemplary and explanatory and are intended to provide further explanation of the invention as claimed.

BRIEF DESCRIPTION OF THE DRAWINGS

Preferred forms of the present invention will now be described by way of examples with reference to the accompanying drawings.

DETAILED DESCRIPTION OF THE PREFERRED EMBODIMENTS

Figure 1:
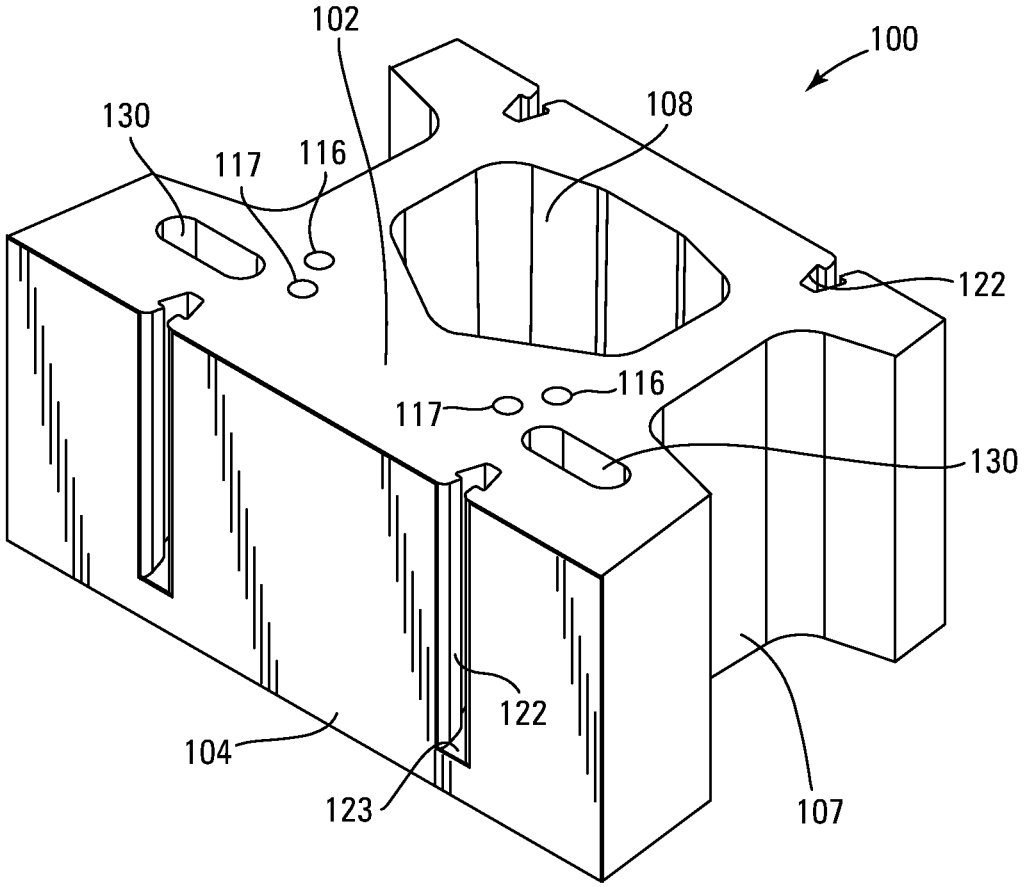
FIG. 1 is a top perspective view of a wall block of the present invention.
Figure 2:
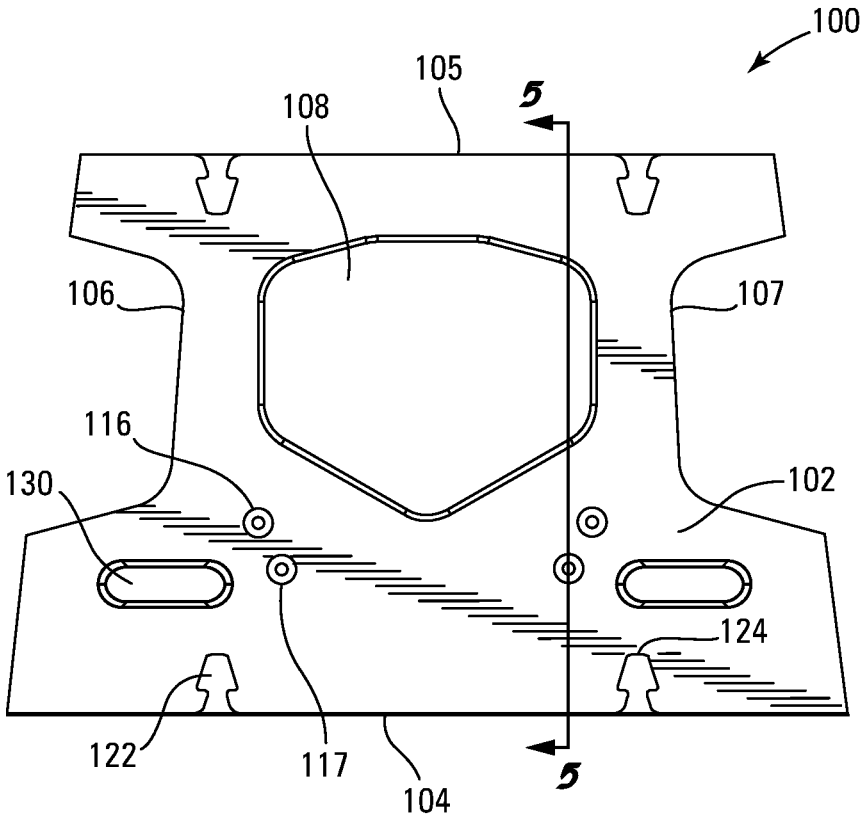
FIG. 2 is a top view of the block.
Figure 3:
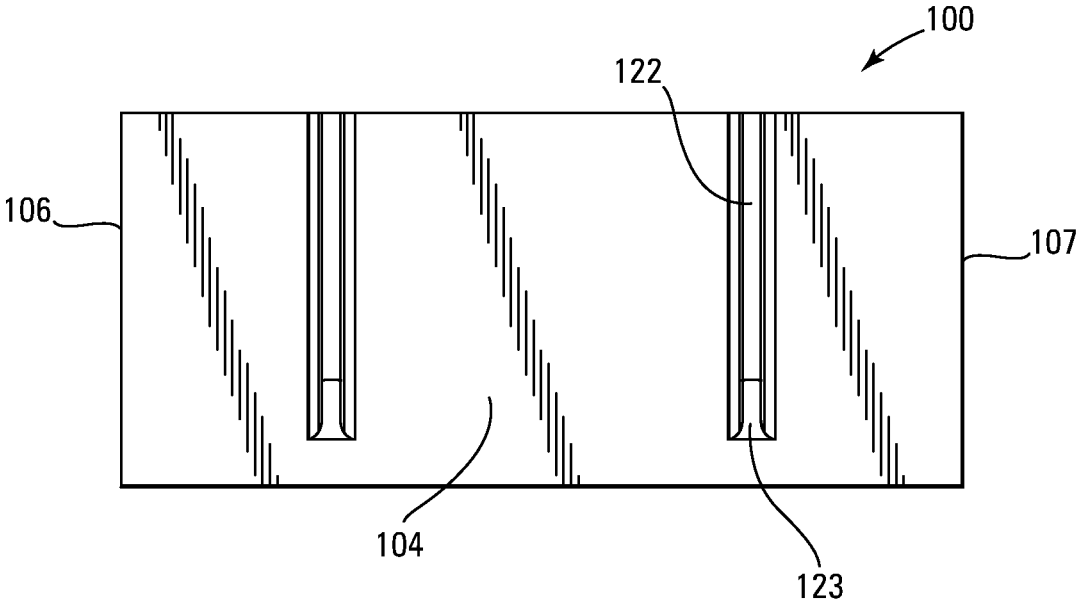
FIG. 3 is a front view of the block.
Figure 4:
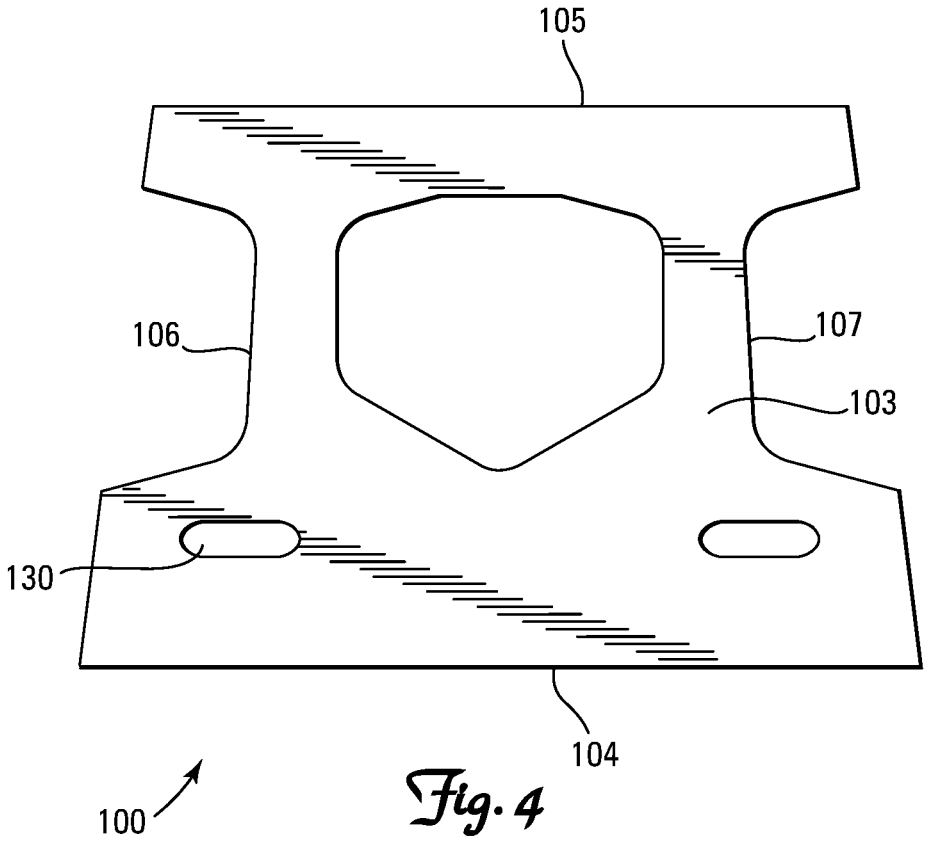
FIG. 4 is a bottom view of the block.

In one embodiment of the invention, veneer panels are used with retaining wall blocks. The retaining wall blocks can be made of a rugged, weather resistant material, preferably dry cast or wet cast molded concrete. Other suitable materials include polymers, especially high density foam polymers, fiberglass, wood, metal, glass, stone, and composite materials with reinforced fibers, etc. The blocks may have various shapes and characteristics, as known in the art, and may be stacked one upon the other to provide a vertically straight wall, and also may be stacked so that they are angled or set back from vertical. As known in the art, the blocks may be connected to each other by a pin attachment system, or the blocks may be provided with one or more protruding elements that interlock with one or more corresponding recesses in an adjacent block.

"Upper" and "lower" refer to the placement of the block in a retaining wall or fence system. The lower, or bottom, surface is placed such that it faces the ground. In a retaining wall, one row of blocks is laid down, forming a course. An upper course is formed on top of this lower course by positioning the lower surface of one block on the upper surface of another block, typically in a running or half bond pattern and not in a stacked pattern.

Retaining walls may be straight (i.e., substantially linear, as well as vertically straight or plumb), curved (concave, convex, or serpentine) or may have angled corners (i.e., 90 degree angles, obtuse angles or acute angles of a buildable degree). Such walls can be angled or setback from vertical. Reinforcing geogrid mesh or geosynthetic fabrics (also referred to generally as geogrids and geotextiles) may be used with retaining wall blocks to create a reinforced soil structure where the wall has one exposed face and where the geogrid is attached to the block via the pinning connection that comes out through the back face and into the backfilled soil at desired intervals.

The blocks of this invention may be symmetrical about a vertical plane of symmetry. The blocks may optionally be provided with pin holes, pin receiving cavities, pin receiving channels, or cores which serve to decrease the weight of the block while maintaining its strength while also providing ease of construction of a retaining wall. The location, shape, and size of the pin holes, pin receiving cavities, pin receiving channels, or cores are selected to maximize the strength of the block, as described by reference to the drawings.

The veneers or veneer panels of this invention may be comprised of any suitable material such as high strength concrete, dry cast or wet cast concrete, polymers, composites, natural stone, metal, wood, glass, porcelain or a mineral aggregate in fiberglass. An alternative veneer is comprised of natural stone with a concrete base or backing.

High strength concrete (6,000 psi (41,000 kPa) and higher) may also be used in the making of the veneer panels which are compacted under vibration to make the veneer panels extremely durable and strong. Various liquid or dry pigments may be added to the concrete mix in order to create different colors or shades of color. The mold of the veneer panel may be configured to impart a surface texture to the material that resembles the texture of natural stone. The high density and strength of the concrete veneer panel make it more resistant to weather and other natural forces.

It is to be emphasized that the surface of a veneer panel may have any desired appearance. A natural appearance, such as stone, is generally most desirable. The panel may have a uniform single stone appearance or it may have an ashlar multi-stone pattern formed into it. The panels may also resemble stone that has been processed or treated as is commonly known in the natural stone industry. For example, the panel may resemble a weathered stone, polished stone, or flame treated stone. In addition, the veneer panels may be molded or configured to produce panels that resemble stone that has been hand or machine pitched or tumbled to produce an aesthetically pleasing natural quarried stone appearance. In addition, the veneer panel can be manufactured to have any desired appearance, whether natural or manmade. A combination of geometric forms and shapes, along with natural appearing aesthetics are all possible by adding the veneer panel to the structural support block of this system.

FIGS. 1 to 6 show features of wall block 100. Block 100 is made of a rugged, weather resistant material, preferably dry cast or wet cast molded concrete. Other suitable materials include plastic, reinforced fibers, wood, metal and stone. Block 100 can be made by methods known in the art. Block 100 has parallel top face 102 and bottom face 103, front face 104, rear face 105 and first and second side walls 106 and 107. Front face 104 and rear face 105 each extend from top face 102 to bottom face 103. Side walls 106 and 107 extend from top face 102 to bottom face 103 and from front face 104 to rear face 105. A core 108 extends from top face 102 to bottom face 103.

Front face 104 has connector channels 122 for receiving a veneer connector that is oriented in the direction from the top face 102 to the bottom face 103 of the block 100. Each connector channel opens into the top face 102 of the block 100 and the front face 104 or the rear face 105 of the block 100 and not opening into the front face 104 or the rear face 105 of the block 100 for the entire distance from the top face 102 to the bottom face 103 of the block. Each connector channel 122 comprises a lower surface 123 in the form of a ramp that extends from the front face 104 or the rear face 105 of the block 100 to a back surface 124 of the connector channel, the ramp 123 rising from the front face 104 or rear face 105 of the block 100 to the back surface 124 of the connector channel 122. The connector channel 122 forms a main connection space 125 and a narrower neck portion space 126, the narrower neck portion space 126 being closer to the face that the connector channel 122 opens onto (front face 104 or rear face 105 of the block 100). See FIG. 6.

Figure 5:
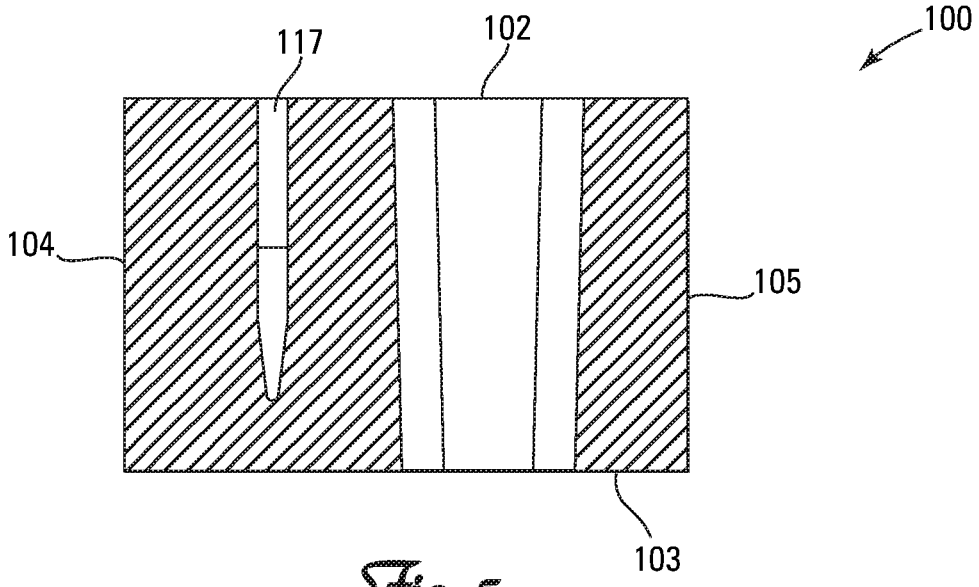
FIG. 5 is a cross-section view of the block; a line showing the cross-section is shown in FIG. 2 and is labeled "5".
Figure 6:
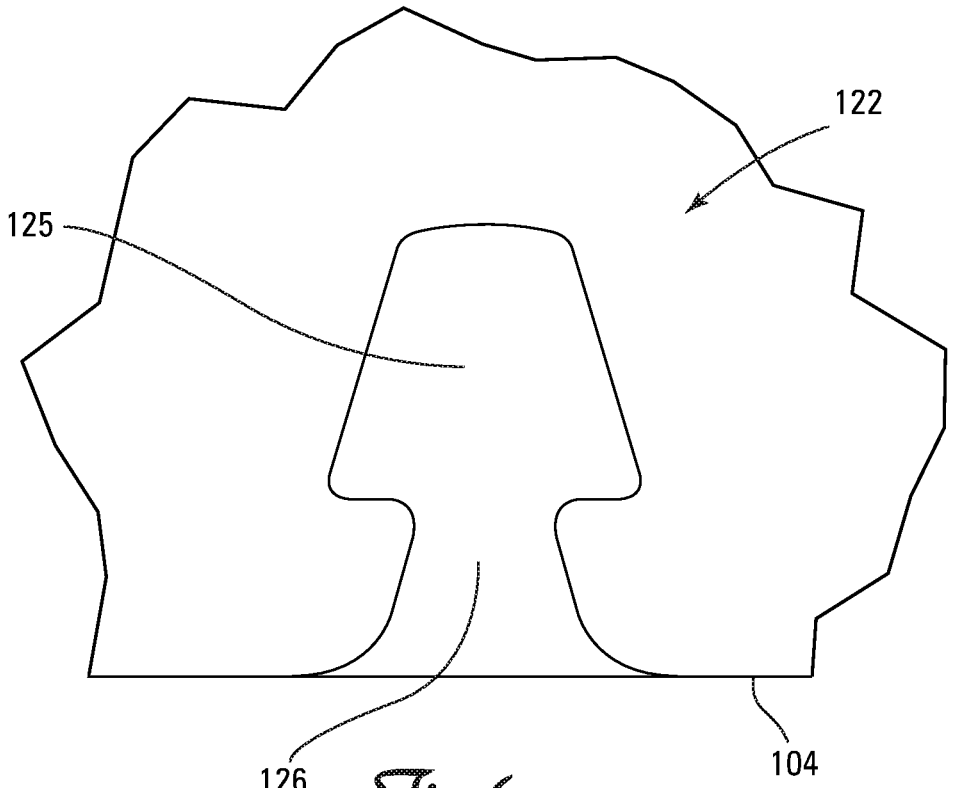
FIG. 6 is an expanded views of a connector channel of the block.

The top face 102 of the wall block 100 comprises exactly four pin holes 116 and 117. As shown in FIG. 5, the pin holes 116 and 117 do not extend to the bottom face 103 and the diameter of pin holes 116, 117 tapers towards the bottom face 103. Pin holes 116, 117 are sized to receive pin 50. The first pin holes 116 are positioned slightly set back towards rear face 105 and towards side walls 106 and 107, relative to second pin holes 117. Second pin holes 117 are located closer to front face 104, relative to first pin holes 116. The location of the pin holes forms two pairs of pinholes located around the central core 108 of the block and provides a way to connect courses of block to another course in a running or half bond pattern to strengthen the wall and structure being built and also provides a way to offset the vertical orientation when stacking of the blocks when constructing a wall depending upon the application. First pin holes 116 provide increased setback as compared to that provided by second pin holes 117. Further pin holes can be provided, if desired, so as to provide for further choices of predetermined setback. Additionally, the location of the pin holes in the body of the block may be varied. The wall block comprises pin receiving cavities 130 that extend between the top face 102 and bottom face 103.

Figure 7:
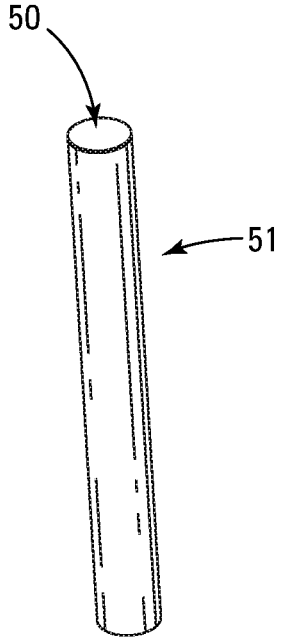
FIG. 7 is a perspective view of a connection pin.

Connection pin 50, as shown in FIG. 7, has a shaft 51 which is placed into pin holes 116, 117 of a top face 102 in a lower course of blocks when constructing a wall. A top portion of pin 50 projects from the top face 102 of the block 100 of the lower course and is received in one of the pin receiving cavities 130 that extends between the top face 102 and bottom face 103 of a block 100 in an upper course of a constructed structure. The shaft 51 of the pin 50 may be circular, square or any other desired shape as well. In this manner, the pin in a block on a lower course of blocks in a wall engages a pin receiving cavity 130 of a block in an upper course.

Though the blocks illustrated in the FIGS. 1 to 6 may have various dimensions, block 100 typically has a height (i.e., the distance between surfaces 102 and 103) of about 8 inches (200 mm), a front face length (i.e., the distance from side wall 106 and side wall 107 at front face 104) of about 18 inches (457 mm), a back face length (i.e., the distance from side wall 106 and side wall 107 at rear face 105) of about 14.84 inches (377 mm), and a width (i.e., the distance from front face 104 to rear face 105) of about 12 inches (300 mm).

It should be noted that front face and rear face are relative terms when constructing a wall from blocks 100 and thus rear face 105 could be placed facing outward and form a front face of a wall. Further front face 104 and rear face 105 can both be alternated or some combination thereof depending upon the application when forming a face of a wall.

Figure 8:
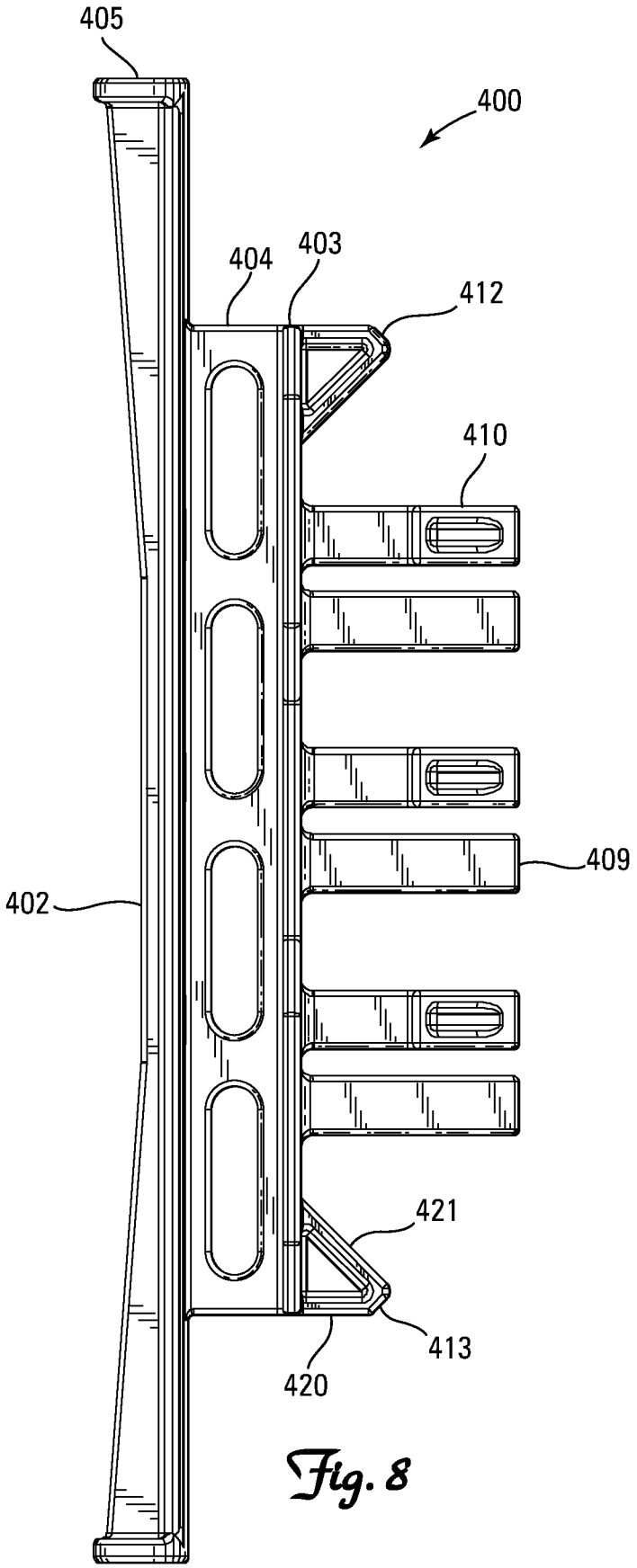
FIG. 8 is a side view of a veneer connector of the present invention.
Figure 9:
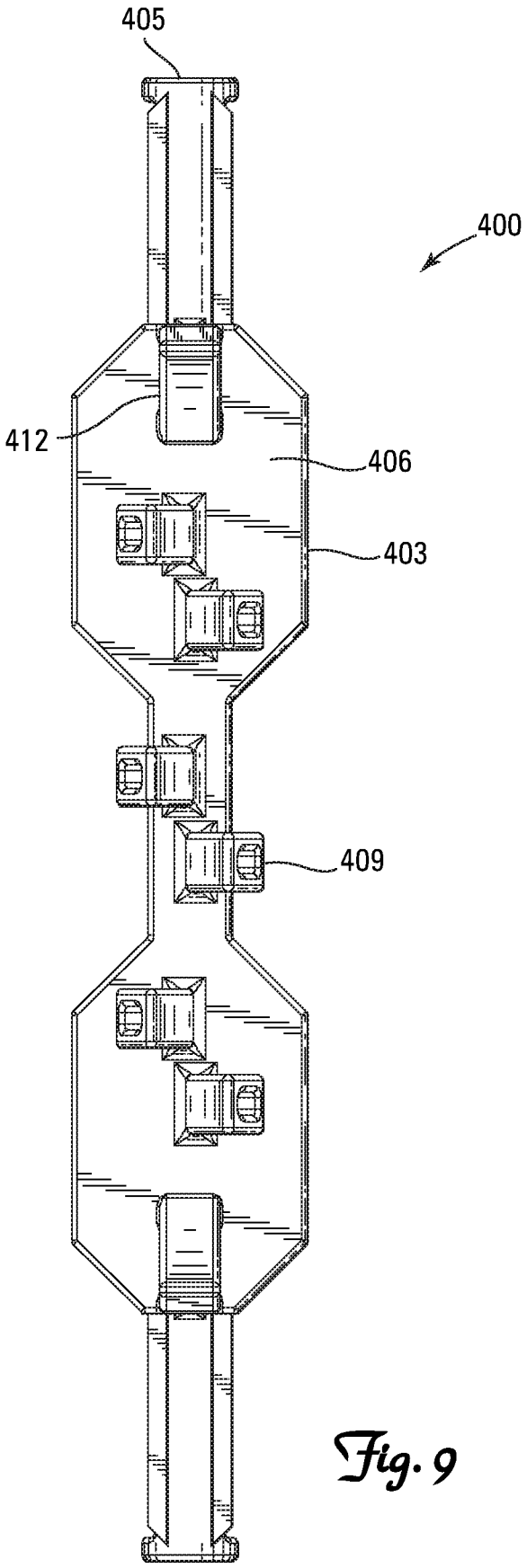
FIG. 9 is a front view of the veneer connector.
Figure 10:
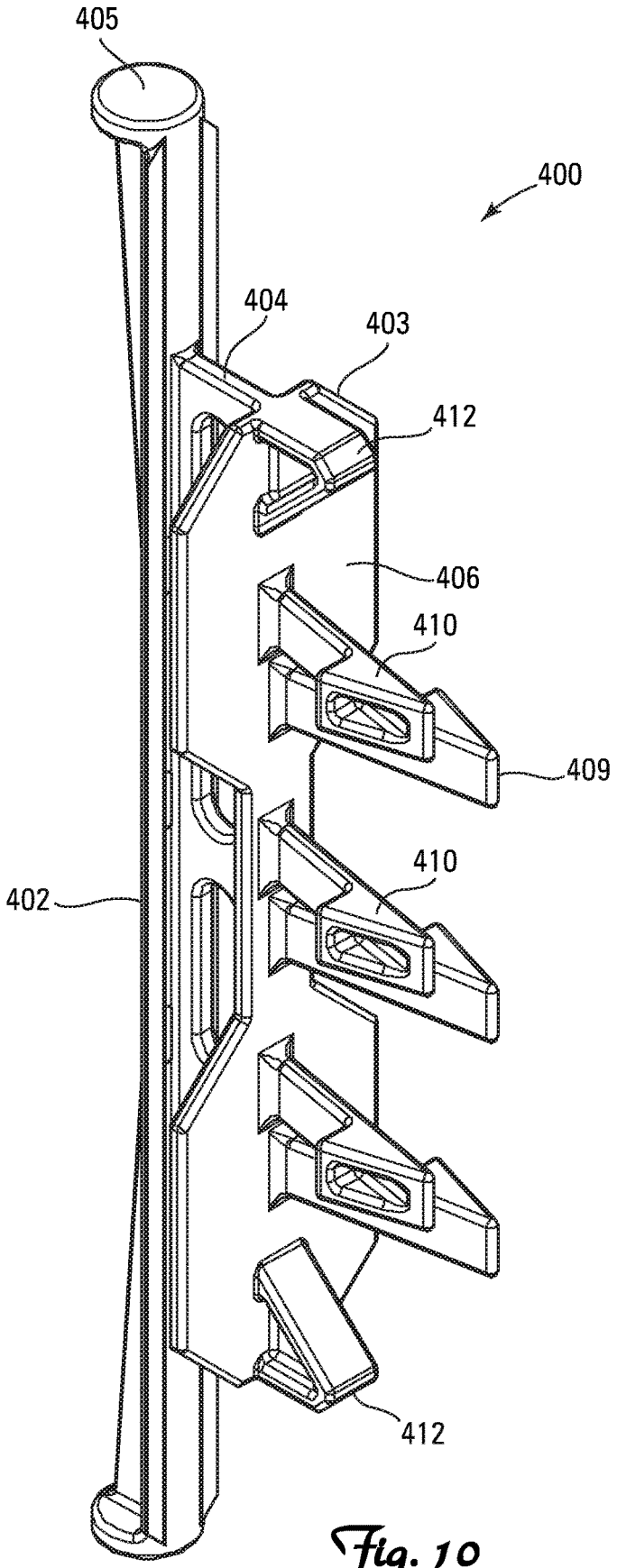
FIG. 10 is a top perspective view of the veneer connector.

FIGS. 8 to 10 illustrate a veneer connector or clip 400 of the present invention. Veneer clip 400 may be made of an injection molded plastic or any other suitable material. Veneer clip 400 has support 402 which includes a plate 403 which has a flat surface 406 that connects to bifurcated horizontal prongs 409. The support 402 also includes a connecting member 404 and a shaft 405. Plate 403 is connected to connecting member 404 which is connected to shaft 405. Stops 412 are connected to the plate 403 and are located above and below the bifurcated horizontal prongs. The stops 412 have a shorter horizontal length than the bifurcated horizontal prongs 409. The stops 412 also have a first planar surface 420 that extends from the flat surface 406 of the support 402 and is perpendicular to the flat surface 406. Veneer clip 400 may be symmetrical about its central x, y and z axes. A second planar surface 421 extends from the flat surface 406 of the support 402 and forms an acute angle with the flat surface 406. A third planar surface 413 connects between the first 420 and second 421 surfaces and forms an obtuse angle with the first planar surface 420. The third planar surface 413 is oriented at a 45 degree angle with respect to the flat surface 406 of the support 402.

In use, the shaft 405 can be placed in a connector channel of a veneer and the bifurcated horizontal prongs and stops can be placed in a connector channel of a block. The shaft 405 and the connecting member 404 could also be embedded within a veneer. The shaft is adapted to being used in a circular connector channel, but other forms can be used.

Figure 11:
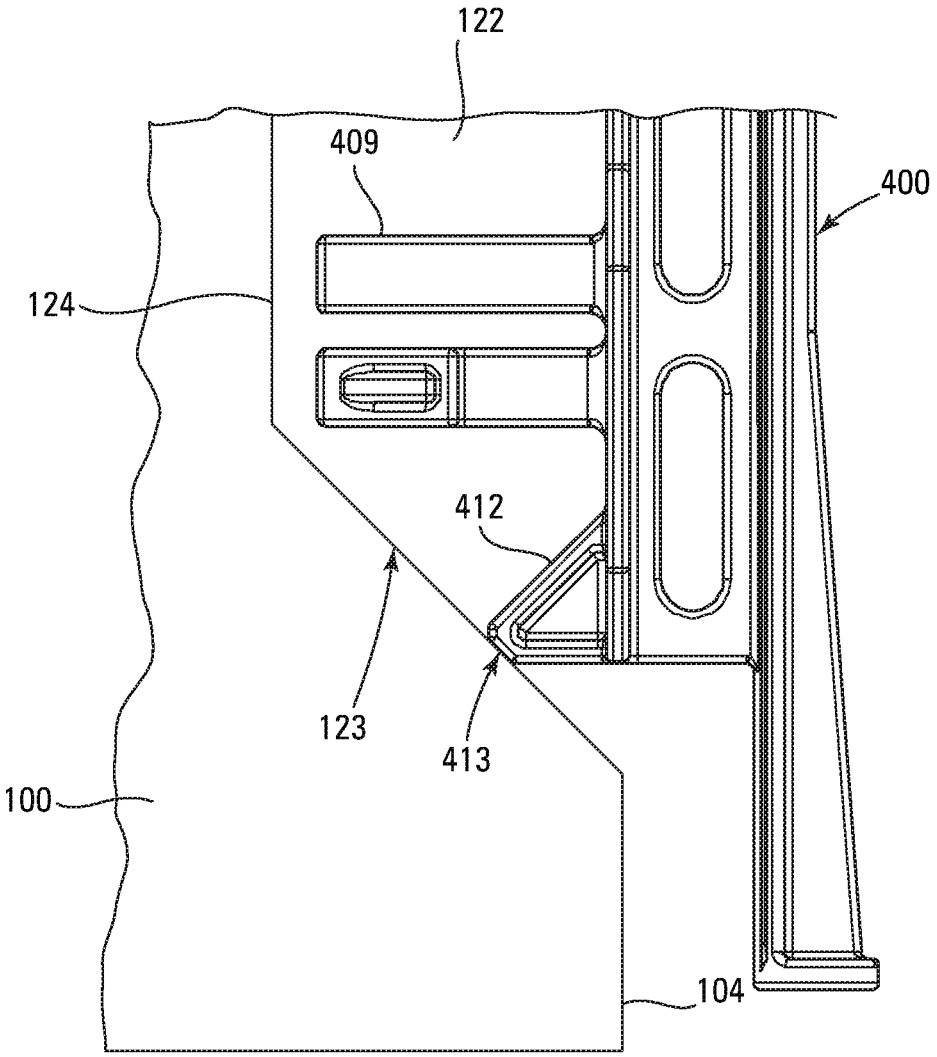
FIG. 11 is a break-away schematic view of a veneer connector of the present invention disposed in the connector channel of a block of the present invention.

In practice, after the veneer connector has been attached to a veneer, the bifurcated horizontal prongs 409 of veneer clip 400 are inserted into a connector channel 122 of a block, either slid on from above or pushed on horizontally. In the push on method, as the bifurcated horizontal prongs enter the connector channel 122, the prongs compress as they enter the narrow neck portion space 126 of the connector channel 122. Once the bifurcated prongs are inserted completely through the narrow neck portion space, the connector channel 122 widens into the main connection space 125 and the bifurcated prongs 409 expand, securing the veneer connector and the veneer panel to the block. Tabs 410 on bifurcated prongs 409 add additional connectivity by interlocking the prongs into the connector channel and not allowing them to be pulled out back through the connector channel once inserted. FIG. 11 shows a portion of a veneer connector 400 after it has been inserted into connector channel 122. The attached veneer is not shown. Prongs 409 and stops 412 are disposed in the connector channel, with angled surface 413 of the veneer connector resting on ramp 123 of connector channel 122.

In this manner the structural wall can first be built without the placement of any veneers. A major benefit to using this type of connector is that the structural wall can be built without having veneer panels attached. Veneers can be added at any point during the wall assembly. This can help in scheduling of materials at the job site, protection of the veneers from general construction damage, or to make building the structural wall an easier job due to lightening the weight of the wall blocks being placed into the wall.

Figure 12:
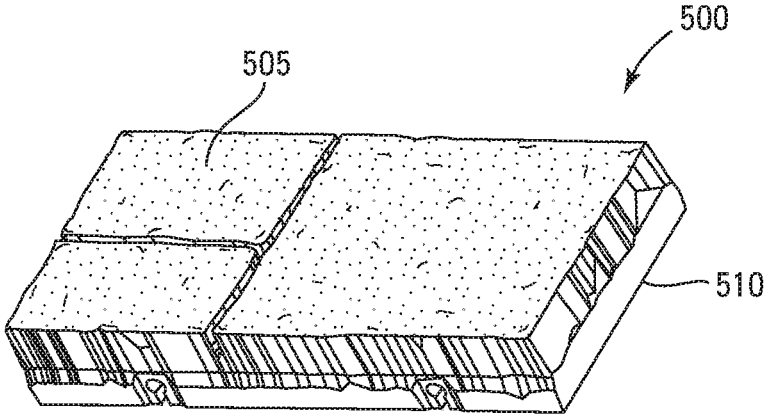
FIGS. 12 and 13 are perspective front and side views, respectively, of a veneer panel of the present invention.
Figure 13:
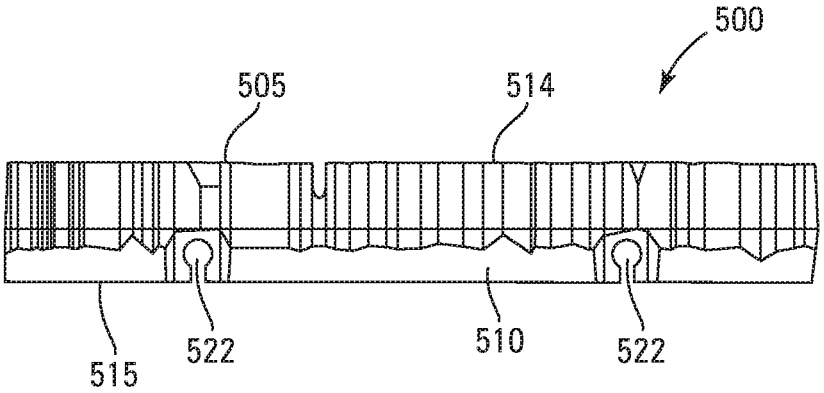

FIGS. 12 and 13 illustrate a natural stone or concrete veneer 500 having a front face 514 and a rear face 515. This veneer 500 could comprise natural stones 505 that are supported on a concrete base 510. Alternatively, the veneer 500 could comprise concrete shaped to look like natural stone. The veneer 500 can have any appearance desired. Connector 400 can be attached to the rear face 515 of the veneer 500 by placing shaft 405 in veneer connector channel 522. Veneer panel 500 usually is dimensioned to be about the same size as the front face of the blocks of the present invention.

Figure 14:
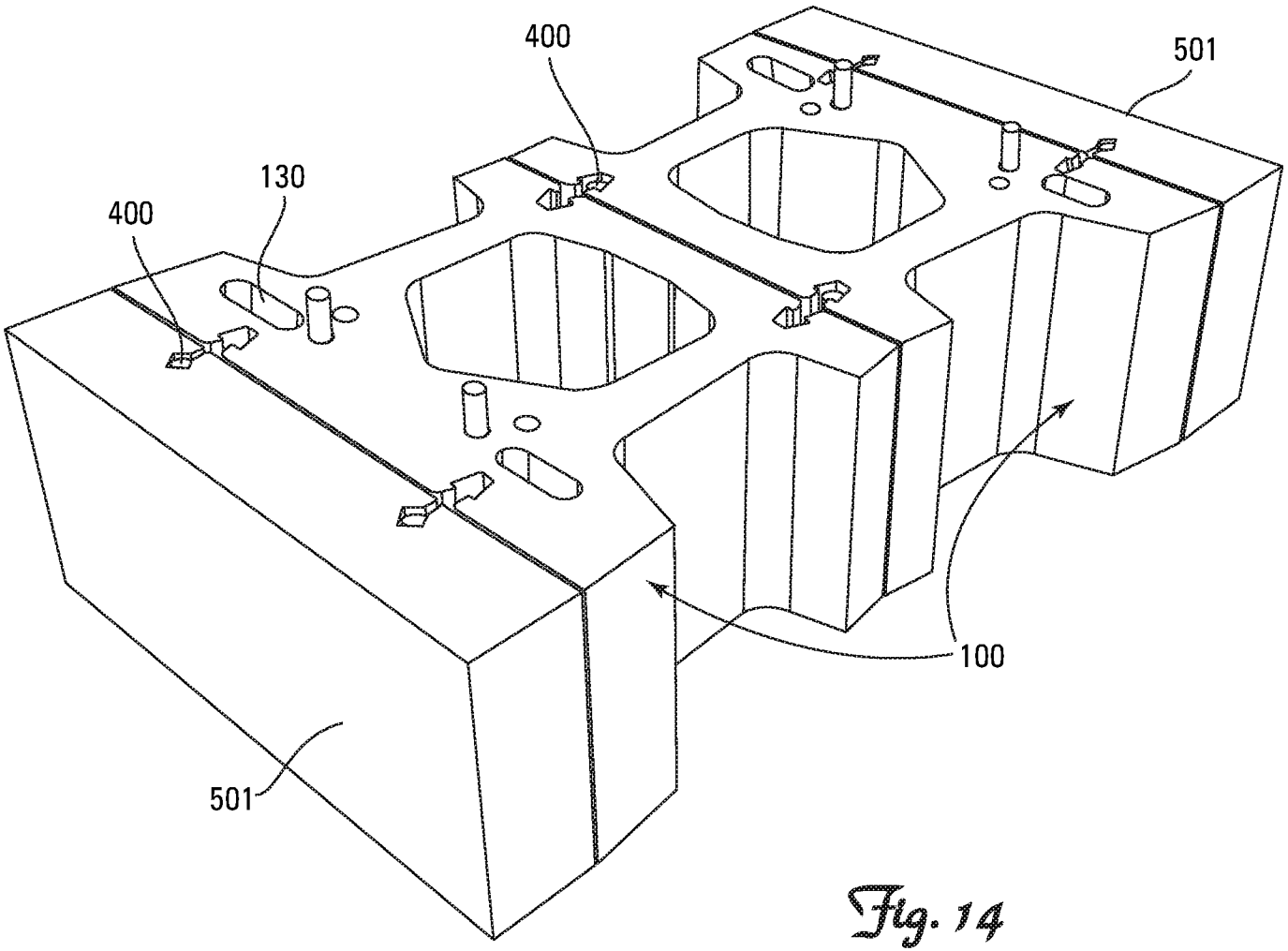
FIG. 14 is a top perspective view of two connected blocks of the invention with their attached veneers.

FIG. 14 shows two blocks 100 with their rear faces 105 connected together with a connector 400 or a similar connector. Veneers 501 are connected to the front faces 104 of the blocks with connectors 400. Multiple blocks 100 could be connected in this manner to form a wall with veneers on both sides.

Figure 15:
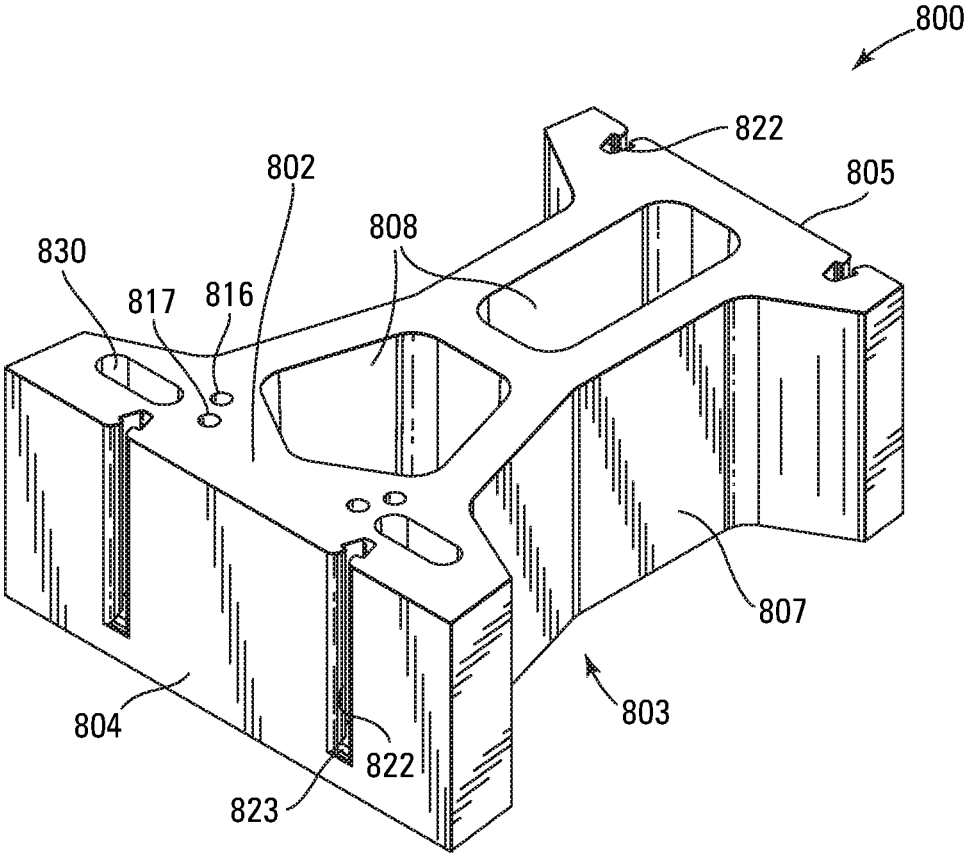
FIG. 15 is a top perspective view of another alternative wall block of the present invention and FIG. 16 is a top view of the block.
Figure 16:
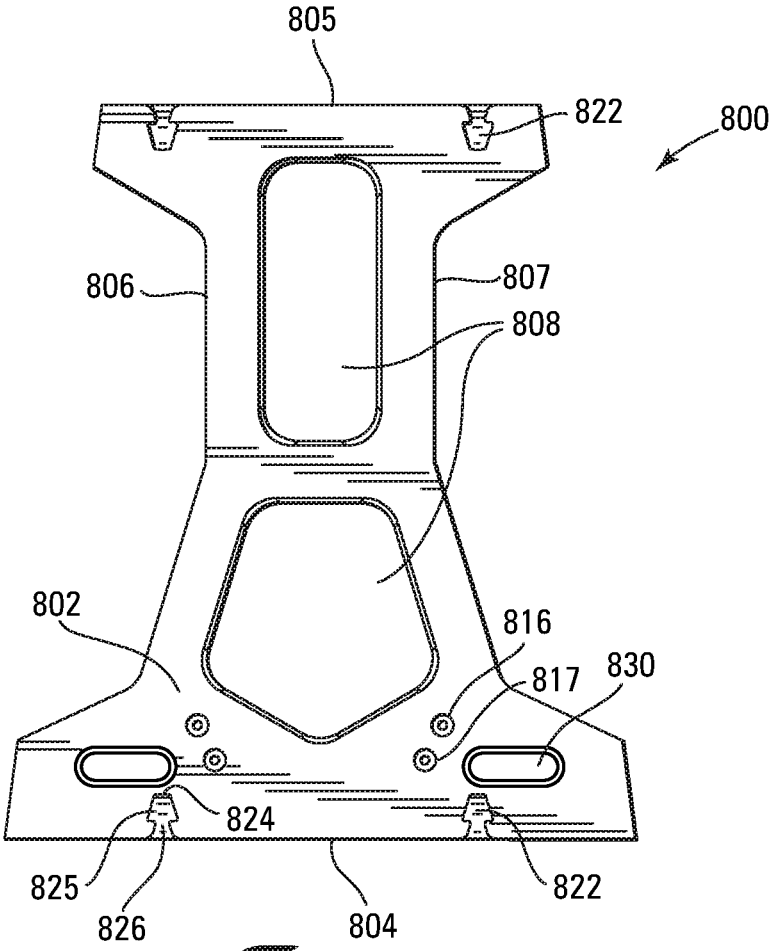

FIGS. 15 and 16 show features of wall block 800. Block 800 is similar to block 100 and can be used in much the same way. Block 800 is made of a rugged, weather resistant material, preferably dry cast or wet cast molded concrete. Other suitable materials include plastic, reinforced fibers, wood, metal and stone. Block 800 can be made be made by methods known in the art. Block 800 has parallel top face 802 and bottom face 803, front face 804, rear face 805 and first and second side walls 806 and 807. Front face 804 and rear face 805 each extend from top face 802 to bottom face 803. Side walls 806 and 807 extend from top face 802 to bottom face 803 and from front face 804 to rear face 805. Two cores 808 extend from top face 802 to bottom face 803.

Front face 804 has connector channels 822 for receiving a veneer connector that is oriented in the direction from the top face 802 to the bottom face 803 of the block 800. Each connector channel opens into the top face 802 of the block 800 and the front face 804 or the rear face 805 of the block 800 and not opening into the front face 804 or the rear face 805 of the block 800 for the entire distance from the top face 802 to the bottom face 803 of the block. Each connector channel 822 comprises a lower surface 823 in the form of a ramp that extends from the front face 804 or the rear face 805 of the block 800 to a back surface 824 of the connector channel, the ramp 823 rising from the front face 804 or rear face 805 of the block 800 to the back surface 824 of the connector channel 822. The connector channel 822 forms a main connection space 825 and a narrower neck portion space 826, the narrower neck portion space 826 being closer to the face that the connector channel 822 opens onto (front face 804 or rear face 805 of the block 800).

The top face 802 of the wall block 800 comprises exactly four pin holes 816 and 817. Similar to pin holes 116 and 117, the pin holes 816 and 817 do not extend to the bottom face 803 and the diameter of pin holes 816, 817 taper towards the bottom face 803. Pin holes 816, 817 are sized to receive pin 50. The first pin holes 816 are positioned slightly set back towards rear face 805 and towards side walls 806 and 807, relative to second pin holes 817. Second pin holes 817 are located closer to front face 804, relative to first pin holes 816. The location of the pin holes forms two pairs of pinholes and provides a way to connect courses of block to another course to strengthen the wall and structure being built and also provides a way to offset the vertical orientation when stacking of the blocks when constructing a wall depending upon the application. First pin holes 816 provide increased setback as compared to that provided by second pin holes 817. Further pin holes can be provided, if desired, so as to provide for further choices of predetermined setback. Additionally, the location of the pin holes in the body of the block may be varied. The wall block comprises pin receiving cavities 830 that extend between the top face 802 and bottom face 803. Blocks 800 can be used to construct walls as described above for blocks 100.

Though the blocks illustrated in the FIGS. 15 and 16 may have various dimensions, block 800 typically has a height (i.e., the distance between surfaces 102 and 103) of about 8 inches (200 mm), a front face length (i.e., the distance from side wall 106 and side wall 107 at front face 104) of about 18 inches (457 mm), a back face length (i.e., the distance from side wall 106 and side wall 107 at rear face 105) of about 11 inches (279 mm), and a width (i.e., the distance from front face 104 to rear face 105) of about 21 inches (533 mm).

Figure 17:
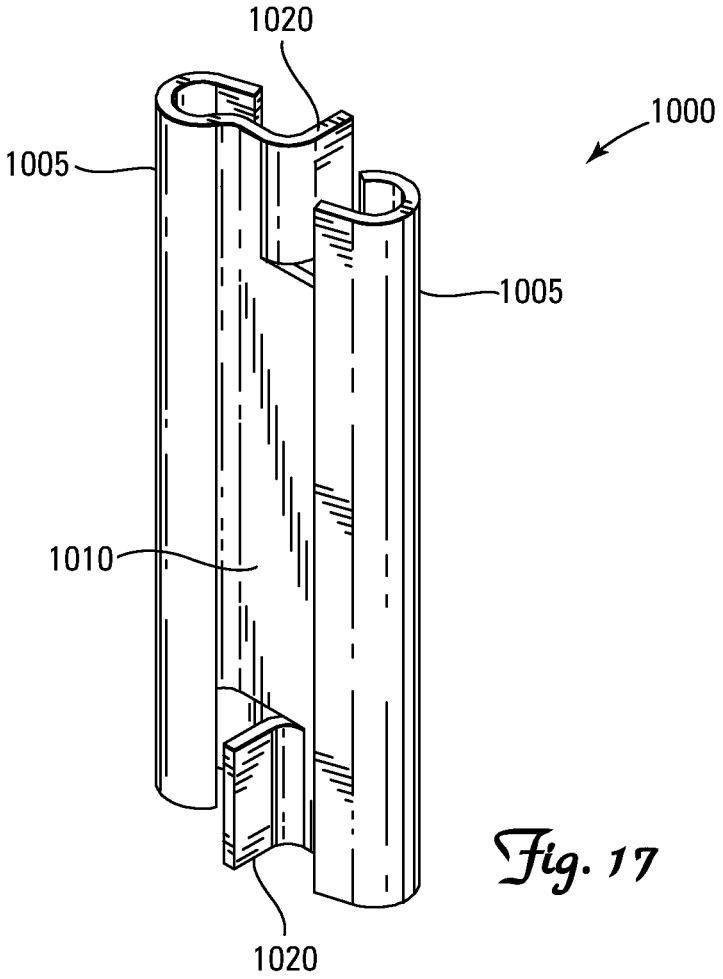
FIG. 17 is a left side perspective view of an alternative veneer connector of the present invention.
Figure 19:
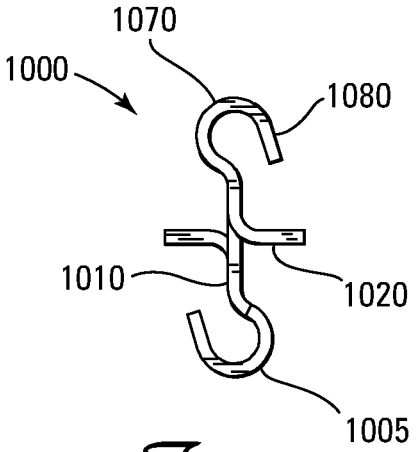
FIG. 19 is a top view of the veneer connector.
Figure 18:
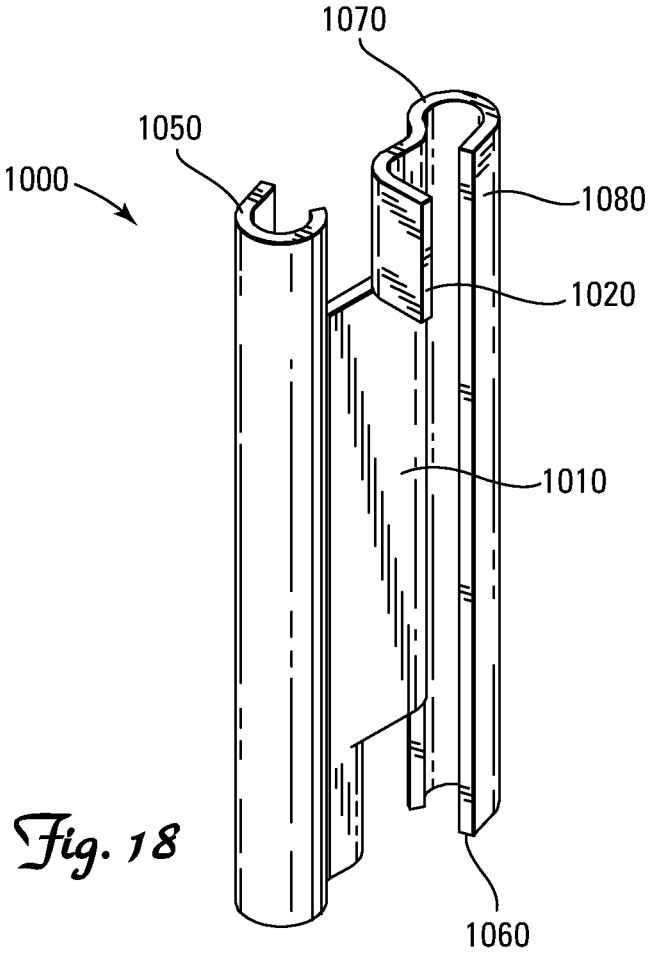
FIG. 18 is a right side perspective view the veneer connector.

FIGS. 17 to 19 illustrate a veneer connector or clip 1000 of the present invention. Veneer clip 1000 may be made of metal such as steel, an injection molded plastic or any other suitable material. Veneer connector 1000 comprises exactly two semi-cylindrical portions 1005 adapted to being placed in a connector channel of a veneer or a block, the two semi-cylindrical portions 1005 being connected by a flat sheet portion 1010, and two tab portions 1020, each tab portion being perpendicular to the flat sheet portion 1010. The veneer connector comprises a top edge 1050 and a bottom edge 1060 and one tab 1020 is adjacent the top edge 1050 and one tab 1020 is adjacent the bottom edge 1060. Each tab portion 1020 is equidistant from the two semi-cylindrical portions. Each semi-cylindrical portion comprises a partial circular cylinder portion that includes more than 150 degrees of a circle when viewed from immediately above the top edge 1050. Each semi-cylindrical portion also comprises a non-cylindrical portion 1080 distal from the flat portion 1010 and the partial circular cylinder portion 1070. The veneer connector can be formed by cutting and bending sheet metal.

Veneer connector 1000 can be used with blocks as described in this application or any appropriate blocks. Veneer connector 1000 is particularly preferred in applications where the veneer is heavy, e.g. 200 pounds (90 kg). In this use, the veneer connector will be made of metal, preferably steel. A particularly preferred veneer for use with the veneer connector is a heavy, wet cast concrete veneer. The veneer is optionally reinforced with rebar or a metal mesh to strengthen the veneer. To increase the stability of walls made with heavy veneers, one or more blocks may be attached to each other to support each veneer. For instance two or more blocks 100 could be attached front face 104 to rear face 105 (or front face to front face or rear face to rear face) using veneer connectors 1000, and then a heavy veneer could be attached to the outermost block 100 using veneer connectors 1000. Optionally, one heavy veneer can be attached to two or more blocks 100.

Figure 20:
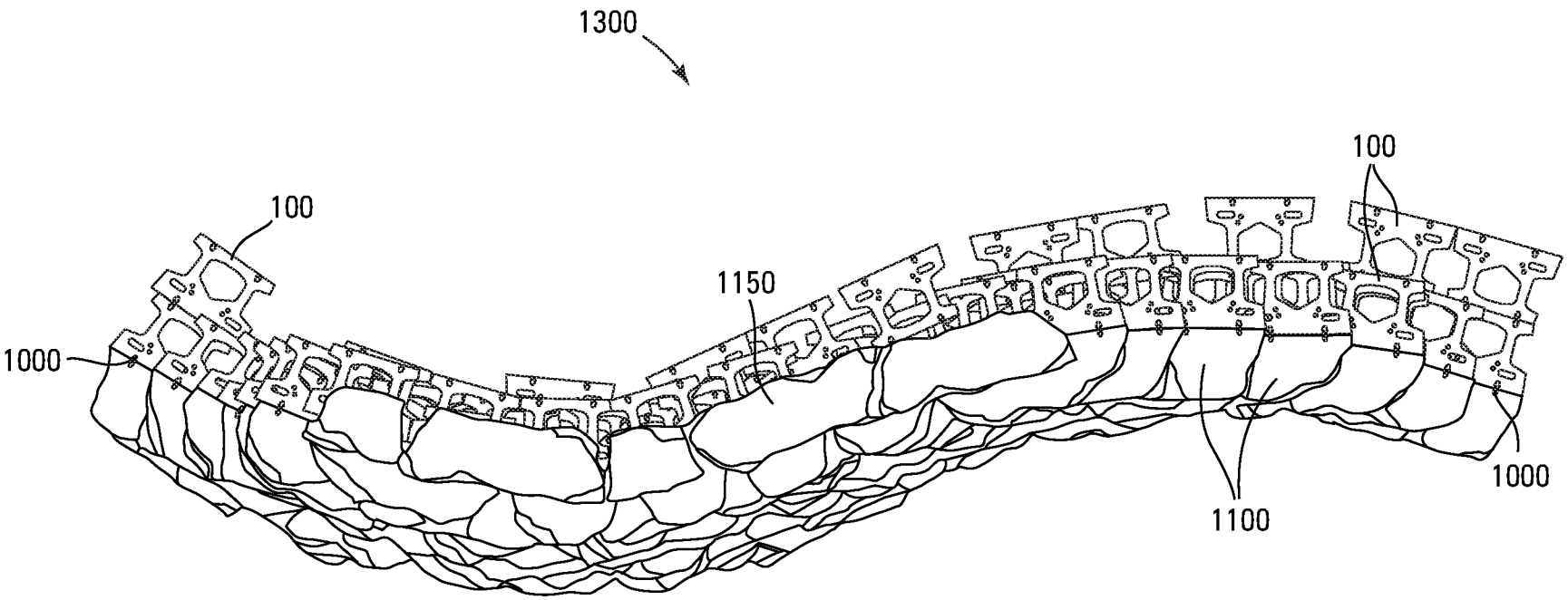
FIG. 20 is a top view of a curved wall built with the blocks, veneer connectors, and veneers of the present invention.
Figure 21:
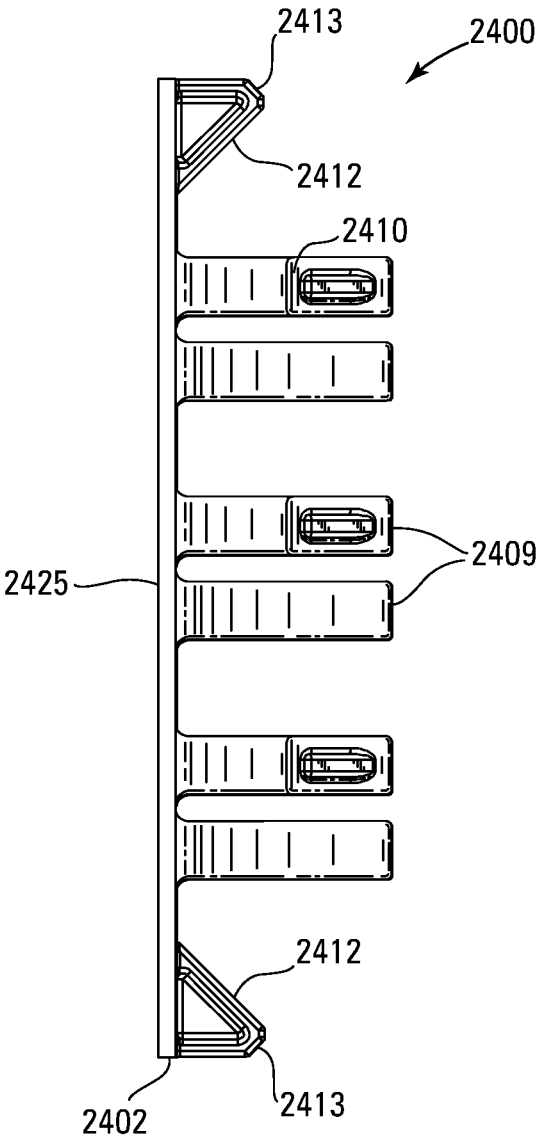
FIG. 21 is a side view of an alternative veneer connector of the present invention.
Figure 22:
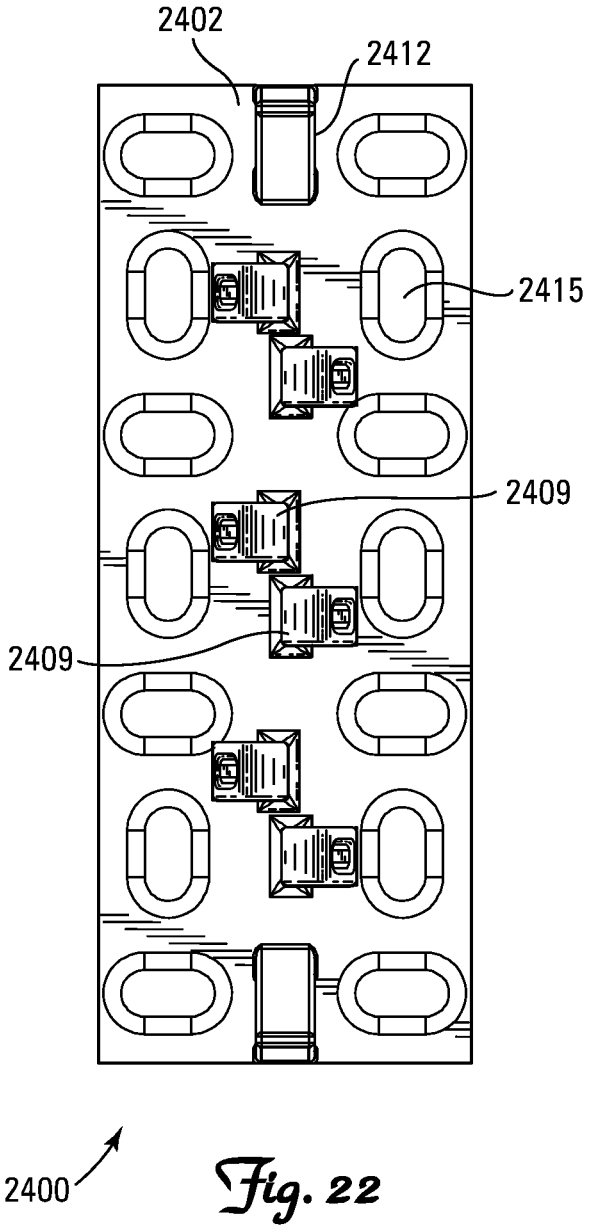
FIG. 22 is a front view of the veneer connector.
Figure 23:
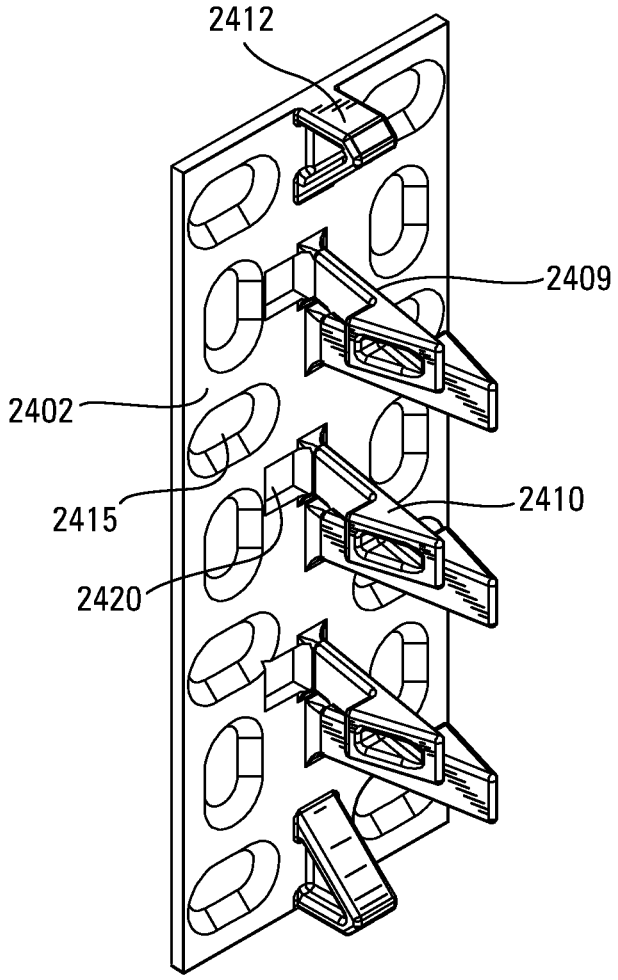
FIG. 23 is a top perspective view of the veneer connector.

FIG. 20 illustrates a curved wall 1300 constructed from blocks 100, veneers 1100, and veneer connectors 1000. Wall 1300 also includes capstones 1150. Veneers 1100 are heavy, wet cast concrete veneers and they are attached to the blocks 100 with the veneer connectors 1000. As shown in FIG. 20, to increase the stability of the wall, some of the blocks 100 are attached front face 104 to rear face 105 (or front face to front face or rear face to rear face) using veneer connectors 1000, and then a heavy veneer 1100 is attached to the outermost block 100 using veneer connectors 1000. This is true using combinations of blocks 100-100, 100-800, 800-800, or any other suitable blocks.

FIGS. 21 to 24 illustrate a veneer connector or clip 2400 of the present invention. Veneer clip 2400 may be made of an injection molded plastic or any other suitable material. Veneer clip 2400 has support plate 2402 connected to bifurcated horizontal prongs 2409. Stops 2412 are connected to the support plate 2402 and are located above and below the bifurcated horizontal prongs. The stops 2412 have a shorter horizontal length than the bifurcated horizontal prongs 2409. The stops 2412 also have angled surface 2413.

Support plate 2402 has oval shaped holes 2415 and rectangular holes 2420, each hole 2415, 2420 having a tapered feature in that it becomes narrower as it reaches closer to rear face 2425. Oval shaped holes 2415 and rectangular shaped holes 2420 allow adhesive to flow up into them when the veneer connector 2400 is attached to a veneer by an adhesive compatible for a permanent bond with the veneer material, thus strengthening the bond between the veneer connector 2400 and the veneer. In practice, excess adhesive is applied to the veneer or the rear face 2425 of the veneer connector 2400 and the veneer and veneer connector are then pressed together.

The support 2402 could take other forms such as a shaft or other shape embedded within a veneer.

Figure 24:
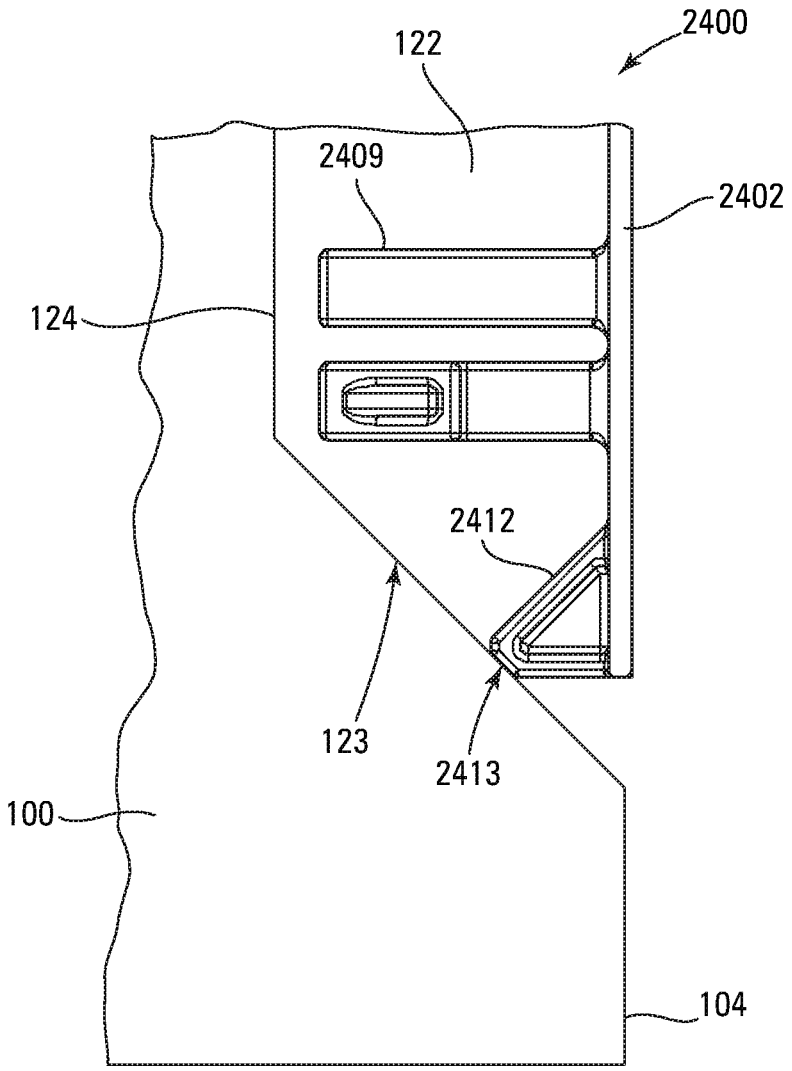
FIG. 24 is a break-away schematic view of a veneer connector of the present invention disposed in the connector channel of a block of the present invention.

In practice, after the veneer connector has been attached to a veneer, the bifurcated horizontal prongs 2409 of veneer clip 2400 are inserted into a connector channel 122, 822 of a block, either slid on from above or pushed on horizontally. In the push on method, as the bifurcated horizontal prongs enter the connector channel 122, 822 the prongs compress as they enter the narrow neck portion space 126, 826 of the connector channel 122, 822. Once the bifurcated prongs are inserted completely through the narrow neck portion space, the connector channel 122, 822 widens into the main connection space 125, 825 and the bifurcated prongs 2409 expand, securing the veneer connector and the veneer panel to the block. Tabs 2410 on bifurcated prongs 2409 add additional connectivity by interlocking the prongs into the connector channel and not allowing them to be pulled out back through the connector channel once inserted. FIG. 24 shows a portion of a veneer connector 2400 after it has been inserted into connector channel 122. The attached veneer is not shown. Prongs 2409 and stops 2412 are disposed in the connector channel, with angled surface 2413 of the veneer connector resting on ramp 123 of connector channel 122.

In this manner the structural wall can first be built without the placement of any veneers. A major benefit to using this type of connector is that the structural wall can be built without having veneer panels attached. Veneers can be added at any point during the wall assembly. This can help in scheduling of materials at the job site, protection of the veneers from general construction damage, or to make building the structural wall an easier job due to lightening the weight of the wall blocks being placed into the wall.

Figure 25:
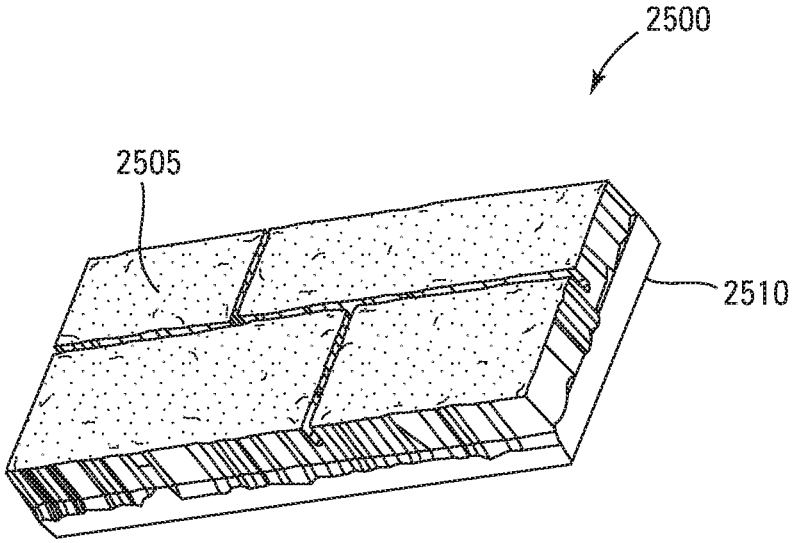
FIGS. 25 and 26 are perspective front and side views, respectively, of a veneer panel of the present invention.
Figure 26:
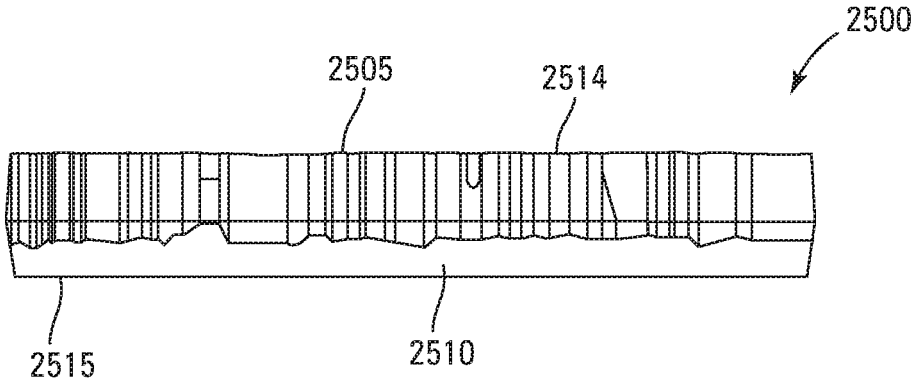

FIGS. 25 and 26 illustrate a natural stone veneer 2500 having a front face 2514 and a rear face 2515. This veneer 2500 comprises natural stones 2505 that are supported on a concrete base 2510. Connector 2400 can be attached with adhesive to the rear face 2515 of the natural stone veneer 2500. Veneer panel 2500 usually is dimensioned to be about the same size as the front face of the blocks of the present invention.

The invention provides a veneer connector comprising a support, bifurcated horizontal prongs that extend from the support and a stop that extends from the support and is located below the bifurcated horizontal prongs. In an embodiment, the veneer connector further comprises a stop located above the bifurcated horizontal prongs. In one embodiment, the bifurcated horizontal prongs have a horizontal length and the stop has a horizontal length, the horizontal length of the stop being less than the horizontal length of the prongs. In an embodiment, the bifurcated horizontal prongs comprise tabs at the ends of the prongs. In one embodiment, the support comprises a flat surface from which the bifurcated horizontal prongs and the stop extend.

In an embodiment, the stop comprises a first planar surface that extends from the flat surface of the support and is perpendicular to the flat surface, a second planar surface that extends from the flat surface of the support and forms an acute angle with the flat surface, and a third planar surface that connects between the first and second surfaces and forms an obtuse angle with the first planar surface. In one embodiment, the third planar surface is oriented at a 45 degree angle with respect to the flat surface of the support. In an embodiment, the support is in the form of a plate.

In one embodiment, the support comprises a shaft having a length longer than the maximum length of the flat surface from which the bifurcated horizontal prongs and the stop extend. In an embodiment, the shaft is adapted to being placed securely in a connector channel of a veneer.

The invention provides a veneer connector comprising exactly two semi-cylindrical portions adapted to being placed in a connector channel of a veneer or a block, the two semi-cylindrical portions being connected by a flat sheet portion, and one or more tab portions, each tab portion being perpendicular to the flat sheet portion. In an embodiment, the veneer connector comprises exactly two tab portions. In one embodiment, the connector comprises a top edge and a bottom edge and the one or more tab portions are adjacent to one of the top or bottom edges. In an embodiment, a first tab portion is adjacent to the top edge and a second tab portion is adjacent to the bottom edge. In one embodiment, each tab portion is equidistant from the two semi-cylindrical portions. In an embodiment, each semi-cylindrical portion comprises a partial circular cylinder portion that includes at least 150 degrees of a circle when viewed from immediately above the top edge. In one embodiment, each semi-cylindrical portion comprises a non-cylindrical portion distal from the flat portion and the partial circular cylinder portion. In an embodiment, the veneer connector is made of metal. In one embodiment, the veneer connector is made of steel. In one embodiment, the veneer connector is formed from a single sheet of material.

The invention provides a combination comprising a veneer and a veneer connector, the veneer connector comprising a support, bifurcated horizontal prongs that extend from the support and a stop that extends from the support and is located below the bifurcated horizontal prongs. The invention may also provide a structural block having channels to receive the veneer and veneer connector. In one embodiment, the veneer connector is fixedly attached to the veneer. In an embodiment, the veneer connector is fixedly attached with an adhesive. In one embodiment, a portion of the veneer connector is disposed within a connector channel of the veneer. In an embodiment, the veneer connector further comprises a stop located above the bifurcated horizontal prongs. In one embodiment, the bifurcated horizontal prongs have a horizontal length and the stop has a horizontal length, the horizontal length of the stop being less than the horizontal length of the prongs. In an embodiment, the bifurcated horizontal prongs comprise tabs at the ends of the prongs. In one embodiment, the support comprises a flat surface from which the bifurcated horizontal prongs and the stop extend. In an embodiment, the stop comprises a first planar surface that extends from the flat surface of the support and is perpendicular to the flat surface, a second planar surface that extends from the flat surface of the support and forms an acute angle with the flat surface, and a third planar surface that connects between the first and second surfaces and forms an obtuse angle with the first planar surface. In one embodiment, the third planar surface is oriented at a 45 degree angle with respect to the flat surface of the support. In an embodiment, the support is in the form of a plate. In one embodiment, the support comprises a shaft having a length longer than the maximum length of the flat surface from which the bifurcated horizontal prongs and the stop extend. In an embodiment, the shaft is adapted to being placed securely in a connector channel of a veneer. In one embodiment, the veneer is a real stone veneer. In an embodiment, the veneer is a concrete veneer.

The invention provides a combination comprising a veneer and a veneer connector, the veneer connector comprising exactly two semi-cylindrical portions adapted to being placed in a connector channel of a veneer or a block, the two semi-cylindrical portions being connected by a flat sheet portion, and one or more tab portions, each tab portion being perpendicular to the flat sheet portion. In one embodiment, one of the two semi-cylindrical portions of the veneer connector is disposed within a connector channel of the veneer. In an embodiment, each tab portion is equidistant from the two semi-cylindrical portions. In one embodiment, the veneer connector is made of metal. In an embodiment, the veneer connector is made of steel. In one embodiment, the veneer is a real stone veneer. In an embodiment, the veneer is a concrete veneer. In one embodiment, the concrete veneer has metal mesh reinforcement.

The invention provides a combination comprising a wall block, a veneer, and a veneer connector, the wall block comprising parallel top and bottom faces, a front face and one or more rear faces, each rear face being parallel to the front face, and first and second side walls, the first and second side walls extending from the top face to the bottom face and from the front face to the one or more rear faces; and a connector channel for receiving a veneer connector that is oriented in the direction from the top face to the bottom face of the block, the connector channel opening into the top face of the block and one of the front or rear faces of the block and not opening into the one of the front or rear faces of the block for the entire distance from the top face to the bottom face of the block. The veneer connector comprising a support, bifurcated horizontal prongs that extend from the support and a stop that extends from the support and is located below the bifurcated horizontal prongs; and a portion of the veneer connector being disposed with the wall block connector channel. In one embodiment, the veneer connector is fixedly attached to the veneer. In an embodiment, the veneer connector is fixedly attached with an adhesive. In one embodiment, a portion of the veneer connector is disposed within a connector channel of the veneer. In an embodiment, the veneer connector further comprises a stop located above the bifurcated horizontal prongs. In one embodiment, the bifurcated horizontal prongs have a horizontal length and the stop has a horizontal length, the horizontal length of the stop being less than the horizontal length of the prongs. In an embodiment, the bifurcated horizontal prongs comprise tabs at the ends of the prongs. In one embodiment, the support comprises a flat surface from which the bifurcated horizontal prongs and the stop extend. In an embodiment, the stop comprises a first planar surface that extends from the flat surface of the support and is perpendicular to the flat surface, a second planar surface that extends from the flat surface of the support and forms an acute angle with the flat surface, and a third planar surface that connects between the first and second surfaces and forms an obtuse angle with the first planar surface. In one embodiment, the third planar surface is oriented at a 45 degree angle with respect to the flat surface of the support. In an embodiment, the support is in the form of a plate. In an embodiment, the support comprises a shaft having a length longer than the maximum length of the flat surface from which the bifurcated horizontal prongs and the stop extend. In one embodiment, the shaft is adapted to being placed securely in a connector channel of a veneer. In an embodiment, the wall block connector channel comprises a lower surface in the form of a ramp that extends from one of the front or rear faces of the block to a back surface of the connector channel, the ramp rising from the one of the front or rear faces of the block to the back surface of the connector channel; the bifurcated horizontal prongs are disposed in the wall block connector channel; and the stop is disposed in the wall block connector channel and contacts the ramp. In one embodiment, the wall block is a concrete wall block. In an embodiment, the veneer is a real stone veneer. In one embodiment, the veneer is a concrete veneer.

The invention provides a combination comprising a wall block, a veneer, and a veneer connector, the wall block comprising parallel top and bottom faces, a front face and a rear face, the rear face being parallel to the front face, and first and second side walls, the first and second side walls extending from the top face to the bottom face and from the front face to the rear face; and a connector channel for receiving a veneer connector that is oriented in the direction from the top face to the bottom face of the block, the connector channel opening into the top face of the block and one of the front or rear faces of the block. The veneer connector comprising exactly two semi-cylindrical portions adapted to being placed in a connector channel of a veneer or a block, the two semi-cylindrical portions being connected by a flat sheet portion, and one or more tab portions, each tab portion being perpendicular to the flat sheet portion; and a portion of the veneer connector being disposed with the wall block connector channel. In one embodiment, a portion of the veneer connector is disposed within a connector channel of the veneer. In an embodiment, each tab portion is equidistant from the two semi-cylindrical portions. In one embodiment, the veneer connector is made of metal. In an embodiment, the veneer connector is made of steel. In an embodiment, the wall block is a concrete wall block. In one embodiment, the veneer is a real stone veneer. In an embodiment, the veneer is a concrete veneer. In one embodiment, the concrete veneer has metal mesh reinforcement.

The invention provides a wall comprising a first course and a second course of wall blocks that may be assembled in a running or half bond pattern, a plurality of wall blocks comprising parallel top and bottom faces, a front face and a rear face, the rear face being parallel to the front face, and first and second side walls, the first and second side walls extending from the top face to the bottom face and from the front face to the rear face; and a connector channel for receiving a veneer connector that is oriented in the direction from the top face to the bottom face of the block, the connector channel opening into the top face of the block and one of the front or rear faces of the block; a plurality of veneer connectors comprising exactly two semi-cylindrical portions adapted to being placed in a connector channel of a veneer or a block, the two semi-cylindrical portions being connected by a flat sheet portion, and one or more tab portions, each tab portion being perpendicular to the flat sheet portion; and a portion of the veneer connectors being disposed with the wall block connector channels. In one embodiment, the wall is a retaining wall. In an embodiment, veneers are attached to a plurality of the veneer connectors.

The invention provides a wall block comprising parallel top and bottom faces, a front face and a rear face, the rear face being parallel to the front face, and first and second side walls, the first and second side walls extending from the top face to the bottom face and from the front face to the one or more rear faces; and first and second connector channels for receiving veneer connectors that are oriented in the direction from the top face to the bottom face of the block, the first connector channel opening into the top face of the block and the front face of the block and not opening into the front face of the block for the entire distance from the top face to the bottom face of the block, and the second connector channel opening into the top face of the block and the rear face of the block and not opening into the rear face of the block for the entire distance from the top face to the bottom face of the block. In one embodiment, the front face of the block comprises exactly two connector channels, each connector channel oriented in the direction from the top face to the bottom face of the block, each connector channel opening into the top face of the block and the front face of the block and not opening into the front face of the block for the entire distance from the top face to the bottom face of the block, and wherein the rear face of the block comprises exactly two connector channels, each connector channel oriented in the direction from the top face to the bottom face of the block, each connector channel opening into the top face of the block and the rear face of the block and not opening into the front face of the block for the entire distance from the top face to the bottom face of the block. In an embodiment, the top face of the wall block comprises one or more pin holes. In one embodiment, the top face of the wall block comprises exactly four pin holes. In an embodiment, the wall block comprises a pin receiving cavity. In one embodiment, the pin receiving cavity extends between the top and bottom faces. In an embodiment, each connector channel forms a main connection space and a narrower neck portion space, the narrower neck portion space being closer to the one of the front or rear faces of the block into which the connector channel opens.

It should be noted that the veneer panels that are connected to the wall may have varying shapes and sizes depending upon the application. For example, a veneer panel may be sized to encompass the surface area of multiple faces of adjacent blocks, either vertically adjacent, horizontally adjacent or both. Further the veneer panels may be used with random sizes to create a random aesthetically pleasing surface to a wall. Further, it should be noted that the size and shape of the blocks are not limiting either and that any size or shape may be employed depending upon the application.

Although particular embodiments have been disclosed herein in detail, this has been done for purposes of illustration only, and is not intended to be limiting with respect to the scope of the following appended claims. In particular, it is contemplated by the inventors that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein.

What is claimed is:

1. A combination comprising a veneer and a veneer connector, the veneer connector comprising exactly two semi-cylindrical portions adapted to being placed in a connector channel of a veneer or a block, the two semi-cylindrical portions being connected by a flat sheet portion, the flat sheet portion defining a plane, and two or more tab portions, a first tab portion being present on a first side of the plane and a second tab portion being present on a second side of the plane, each tab portion being perpendicular to the flat sheet portion, and wherein the veneer connector is formed from a single sheet of material.

2. The combination of claim 1, wherein one of the two semi-cylindrical portions of the veneer connector is disposed within a connector channel of the veneer.

3. The combination of claim 1, wherein the veneer connector comprises exactly two tab portions and each tab portion is equidistant from the two semi-cylindrical portions.

4. The combination of claim 1, wherein the veneer connector is made of metal.

5. The combination of claim 1, wherein the veneer connector is made of steel.

6. The combination of claim 1, wherein the veneer is a real stone veneer.

7. The combination of claim 1, wherein the veneer is a concrete veneer.

8. The combination of claim 7, wherein the concrete veneer has metal mesh reinforcement.

9. A combination comprising a wall block, a veneer, and a veneer connector, the wall block comprising parallel top and bottom faces, a front face and a rear face, the rear face being parallel to the front face, and first and second side walls, the first and second side walls extending from the top face to the bottom face and from the front face to the rear face; and a connector channel for receiving a veneer connector that is oriented in the direction from the top face to the bottom face of the block, the connector channel opening into the top face of the block and one of the front or rear faces of the block;

the veneer connector comprising exactly two semi-cylindrical portions adapted to being placed in a connector channel of a veneer or a block, the two semi-cylindrical portions being connected by a flat sheet portion, the flat sheet portion defining a plane, and two or more tab portions, a first tab portion being present on a first side of the plane and a second tab portion being present on a second side of the plane, each tab portion being perpendicular to the flat sheet portion, and wherein the veneer connector is formed from a single sheet of material; and a portion of the veneer connector being disposed within the wall block connector channel.

10. The combination of claim 9, wherein a portion of the veneer connector is disposed within a connector channel of the veneer.

11. The combination of claim 9, wherein the veneer connector comprises exactly two tab portions and each tab portion is equidistant from the two semi-cylindrical portions.

12. The combination of claim 9, wherein the veneer connector is made of metal.

13. The combination of claim 12, wherein the veneer connector is made of steel.

14. The combination of claim 9, wherein the wall block is a concrete wall block.

15. The combination of claim 14, wherein the veneer is a real stone veneer.

16. The combination of claim 14, wherein the veneer is a concrete veneer.

17. The combination of claim 16, wherein the concrete veneer has metal mesh reinforcement.

18. A wall comprising a first course and a second course of wall blocks, a plurality of wall blocks comprising parallel top and bottom faces, a front face and a rear face, the rear face being parallel to the front face, and first and second side walls, the first and second side walls extending from the top face to the bottom face and from the front face to the rear face; and a connector channel for receiving a veneer connector that is oriented in the direction from the top face to the bottom face of the block, the connector channel opening into the top face of the block and one of the front or rear faces of the block; a plurality of veneer connectors comprising exactly two semi-cylindrical portions adapted to being placed in a connector channel of a veneer or a block, the two semi-cylindrical portions being connected by a flat sheet portion, the flat sheet portion defining a plane, and two or more tab portions, a first tab portion being present on a first side of the plane and a second tab portion being present on a second side of the plane, each tab portion being perpendicular to the flat sheet portion, and wherein the veneer connector is formed from a single sheet of material; and a portion of the veneer connectors being disposed within the wall block connector channels.

19. The wall of claim 18, wherein the wall is a retaining wall.

20. The wall of claim 18, wherein veneers are attached to a plurality of the veneer connectors.

* * * * *